US005474142A

United States Patent [19]

Bowden

[11] Patent Number: 5,474,142

[45] Date of Patent: Dec. 12, 1995

[54] AUTOMATIC DRILLING SYSTEM

[76] Inventor: Bobbie J. Bowden, 621 St. Louis St., Gonzales, Tex. 78629

[21] Appl. No.: 50,527

[22] Filed: Apr. 19, 1993

[51] Int. Cl.[6] ..... E21B 19/08

[52] U.S. Cl. ..... 175/27; 175/162; 175/57; 73/732; 73/790

[58] Field of Search ..... 175/24, 27, 52, 175/57, 162; 73/732, 790

[56] References Cited

U.S. PATENT DOCUMENTS

| | | | |
|---|---|---|---|
| 4,165,789 | 8/1979 | Rogers | 175/24 |
| 4,491,186 | 1/1985 | Alder | 175/27 |
| 4,606,415 | 8/1986 | Gray, Jr. et al. | 175/24 |
| 4,639,868 | 1/1987 | Tanaka et al. | 175/24 X |
| 4,662,608 | 5/1987 | Ball | 175/27 |
| 4,793,421 | 12/1988 | Jasinski | 175/27 |
| 4,875,530 | 10/1989 | Frink et al. | 175/27 |

OTHER PUBLICATIONS

Petroleum Engineering, Carl Gatlin, Printice–Hall, 1960, pp. 114–132.

*Primary Examiner*—Ramon S. Britts

*Assistant Examiner*—Frank S. Tsay

*Attorney, Agent, or Firm*—Donald R. Comuzzi; Christopher L. Makay

[57] ABSTRACT

An automatic drilling system regulates the drill string of a drilling rig in response to any one of, any combination of, or all of drilling fluid pressure, bit weight, drill string torque, and drill string RPM to achieve an optimal rate of bit penetration. The automatic drilling system includes a drilling fluid pressure sensor, a bit weight sensor, a drill string torque sensor, and a drill string RPM sensor which deliver a drilling fluid pressure signal, a bit weight signal, a drill string torque signal, and a drill string RPM signal to a drilling fluid pressure regulator, a bit weight regulator, a drill string torque regulator, and a drill string RPM regulator. The regulators control a drill string controller in response to the above signals so that it manipulates the drilling rig to release the drill string at a rate which maintains the maximum rate of bit penetration.

15 Claims, 8 Drawing Sheets

AUTOMATIC DRILLING SYSTEM

BACKGROUND OF THE INVENTION

The present invention relates to automatic drilling systems and, more particularly, but not by way of limitation, to an automatic drilling system that controls the release of a drill string in vertical, directional, and horizonal drilling operations in response to any one of or any combination of bit weight, drilling fluid pressure, drill string torque, and drill string RPM.

DESCRIPTION OF THE RELATED ART

Typical automatic drillers presently control the drill string using only bit weight. Such drillers throttle the brake handle of the cable drum brake in response to decreases in bit weight to release the drill string support cable and, thus, lower the drill string. The lowering of the drill string places additional weight of the drill string on top of the drill bit in order to increase bit weight back to its desired value. A driller operator enters a desired bit weight value into the automatic driller which then compares the desired value to the actual bit weight measured by a weight indicator. As long as the actual bit weight remains within the tolerance of the desired bit weight, the cable drum brake remains engaged, and the drill string support cable supports the drill string at its present level. However, once the weight indicator measures a bit weight that falls outside the desired bit weight entered into the automatic driller by the drilling rig operator, the automatic driller manipulates the brake handle to release the cable drum brake which lowers the drill string cable, thereby placing more weight of the drill string upon the drill bit. The cable drum brake remains released until the weight indicator provides a signal to the automatic driller which substantially equals the desired bit weight.

Although bit weight automatic drillers function adequately for completely vertical boreholes, they cease to operate properly for any type of directional or horizontal drilling operations. Specifically, once the borehole deviates from vertical, the weight indicator, which typically mounts to the drill string cable, no longer measures direct drill string weight but, instead, measures the drill string weight at an angle. As a result, the weight indicator supplies to the automatic driller an erroneous reading of the actual drill string weight on the drill bit. Consequently, the automatic driller will fail to properly control the cable drum brake to release the drill string cable. The drilling operation, therefore, does not operate at an optimal efficiency which reduces the likelihood of successfully completing the borehole as well as increasing the cost of the entire operation.

Accordingly, a need exists for an automatic driller that not only operates through bit weight measurements but also operates in response to other measurements so that directional or horizontal boreholes may be drilled.

SUMMARY OF THE INVENTION

In accordance with the present invention, an automatic drilling system controls the drill string of a drilling rig in response to any one of, any combination of, or all of drilling fluid pressure, bit weight, drill string torque, and drill string RPM to automatically release the drill string of the drilling rig during the drilling of a borehole. The automatic driller includes a drilling fluid pressure sensor, a bit weight sensor, a drill string torque sensor, and a drill string RPM sensor. The sensors output signals representing drilling fluid pressure, bit weight, drill string torque, and drill string RPM to a drilling fluid pressure regulator, a bit weight regulator, a drill string torque regulator, and a drill string RPM regulator, respectively.

The regulators receive their respective signals to measure changes in those signals and produce an output signal representative of any changes. Specifically, the drilling fluid pressure regulator measures changes in drilling fluid pressure and outputs a signal representing those changes. The bit weight regulator measures changes in bit weight and outputs a signal representing those changes. The drill string torque regulator measures changes in drill string torque and output a signal representing those changes. The drill string RPM regulator measures changes in drill string RPM and outputs a signal representing those changes.

Each of the regulators attaches to a relay which is responsive to that regulators output signal to supply a drill string control signal to a drill string controller. The relays connect in series so that all the regulators may be utilized concurrently to provide a drill string control signal to the drill string controller via their respective relays. Furthermore, the relays attach to relay selectors which switch the relays on and off to permit an operator of the automatic driller to select which one of or which combination of the regulators are to control the drilling operation.

The drill string controller attaches to the relays to receive a drill string control signal from the regulator or regulators controlling the drilling operation. Illustratively, when the relay connected to the drilling fluid pressure regulator receives a decrease in drilling fluid pressure signal, it supplies a drill string control signal that operates the drill string controller to effect an increase in the rate of release of the drill string. Conversely, an increase in drilling fluid pressure results in the relay supplying a drill string control signal that operates the drill string controller to effect a decrease in the rate of release of the drill string.

If, however, the relay connected to the bit weight regulator receives a decrease in bit weight signal, it supplies a drill string control signal that operates the drill string controller to effect an increase in the rate of release of the drill string. Conversely, an increase in bit weight results in the relay supplying a drill string control signal that operates the drill string controller to effect a decrease in the rate of release of the drill string.

Alternatively, when the relay connected to the drill string torque regulator receives a decrease in drill string torque signal, it supplies a drill string control signal that operates the drill string controller to effect an increase in the rate of release of the drill string. However, an increase in drill string torque results in the relay supplying a drill string control signal that operates the drill string controller to effect a decrease in the rate of release of the drill string.

Finally, if the relay connected the drill string RPM regulator receives an increase in drill string RPM signal, it supplies a drill string control signal that operates the drill string controller to effect an increase in the rate of release of the drill string. Conversely, a decrease in drill string RPM results in the relay supplying a drill string control signal that operates the drill string controller to effect a decrease in the rate of release of the drill string.

It is, therefore, an object of the present invention to provide an automatic driller capable of automatically controlling the release the drill string of a drilling rig in response to changes in any one of, any combination of, or all of drilling fluid pressure, bit weight, drill string torque, and drill string RPM.

Still other objects, features, and advantages of the present invention will become evident to those skilled in the art in light of the following.

DETAILED DESCRIPTION OF THE PREFERRED EMBODIMENTS

Figure 1:
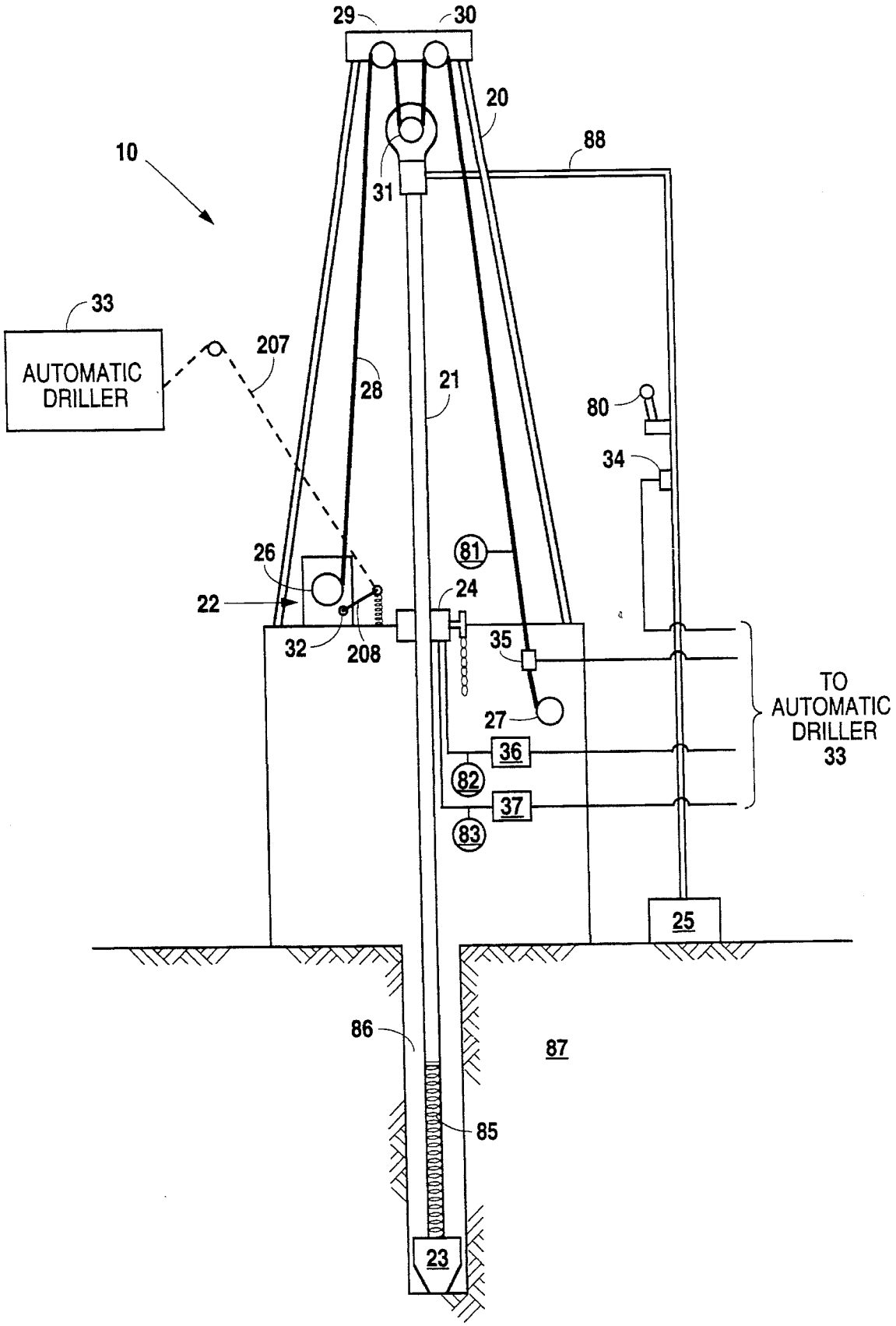
FIG. 1 is a front view depicting a typical drilling rig controlled by the automatic drilling system according to the preferred embodiment of the present invention.

FIG. 1 illustrates a typical drilling rig controlled by the automatic drilling system of the present invention. Drilling rig 10 may be utilized to drill vertical, directional, and horizontal boreholes. Derrick 20 supports drill string 21 within borehole 86 utilizing drawworks 22. Drawworks 22 includes drilling cable drum 26 and drilling cable anchor 27 having drilling cable 28 strung therebetween. Rollers 29 and 30 mount onto derrick 20 to wind cable 28 about travelling block 31, thus suspending drill string 21 from derrick 20. Brake 32 controls the release of cable 28 from drum 26 to adjust the vertical position of drill string 21 with respect to derrick 20.

Rotary table 24 drives drill string 21 to rotate drill bit 23, thereby drilling borehole 86. Additionally, drill string 21 includes mud motor 85 which allows directional and horizontal boreholes to be drilled. To drill borehole 86 into formation 87, rotary table 24 may drive drill string 21 to rotate drill bit 23, or mud motor 85 may rotate drill bit 23, or drill string 21 and mud motor 85 may be used in tandem. However, during a typical drilling operation, mud motor 85 drives drill bit 23 only at the directionalization point of borehole 86 in order to ensure a precise borehole angle, while drill string 21 drives drill bit 23 during straight line drilling.

Pump 25 pumps drilling fluid (i.e. mud) into drill string 21 via drilling fluid line 88, where it travels down drill string 21 to mud motor 85 and drill bit 23. The drilling fluid drives mud motor 85, provides pressure within drill bit 23 to prevent blowouts, and carries drilled formation materials from borehole 86.

Drawworks 22 must adjust drill string 21 vertically along derrick 20 in order to retain drill bit 23 "on bottom" (i.e. on the bottom of borehole 86) and maintain the progression of borehole 86 through formation 87. As long as drill string 21 maintains sufficient and constant pressure on drill bit 23, drill bit 23 will gouge borehole 86 from formation 87 at an optimal rate of penetration chosen based upon the composition of formation 87. Rates of penetration vary from as little as four feet per hour to as much as one hundred and eighty feet per hour. If, however, drawworks 22 did not adjust drill string 21, drill bit 23 would rise "off bottom" (i.e. off the bottom of borehole 86) and the progression of borehole 86 through formation 87 would cease. Accordingly, brake 32 must be manipulated to permit drum 26 to release cable 28 and adjust drill string 21, thereby providing the constant pressure on drill bit 23 required to maintain the optimal rate of penetration.

To maintain drill bit 23 "on bottom" and, thus, the optimal rate of penetration, automatic driller 33 connects to brake handle 208 via cable 207 to regulate the release of cable 28 from drum 26. Automatic driller 33 senses when drill bit 23 is "off bottom" and manipulates brake 32 to release cable 28 and lower drill string 21 until drill bit 23 is again "on bottom". Automatic driller 33 determines when drill bit 23 is "off bottom" by measuring drilling fluid pressure, bit weight, drill string torque, and drill string revolutions per minute (RPM). Drilling fluid pressure sensor 34, bit weight sensor 35, torque sensor 36, and RPM sensor 37 mount onto oil drilling rig 20 to provide signals representative of drilling fluid pressure, bit weight, drill string torque, and drill string RPM to automatic driller 33. Additionally, drilling fluid pressure gauge 80, drill string weight gauge 81, drill string torque gauge 82, and drill string RPM gauge 83 mount on drilling rig 10 to register the respective signals produced by drilling fluid pressure sensor 34, bit weight sensor 35, torque sensor 36, and RPM sensor 37 for the drilling rig operator. Automatic driller 33 may be programmed to utilize any one of the above measurements, any combination of the above measurements, or all of the above measurements to regulate brake 32 and, thus, the position of drill bit 23 within borehole 86.

Figure 4:
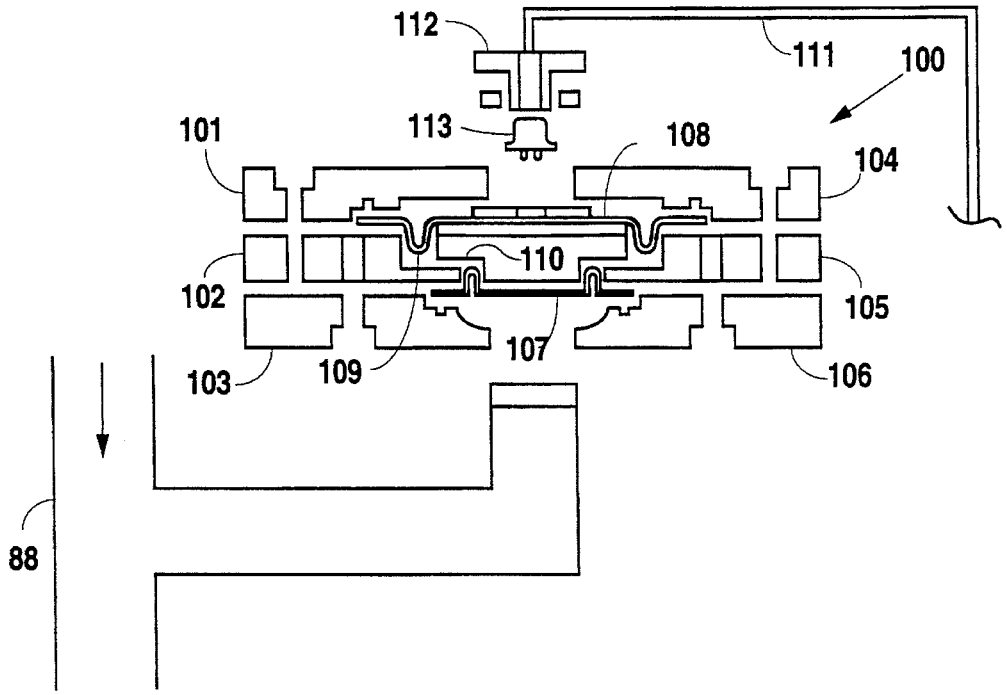
FIG. 4 is a front view depicting a pump pressure sensor according to the preferred embodiment of the present invention.

As shown in FIG. 4, drilling fluid pressure sensor 34 may comprise dual rubber boot sensor 100. Dual rubber boot sensor 100 comprises blocks 101–106 which fit together using any suitable means such as screws to secure rubber boots 107 and 108 within cavity 109. Blocks 101–106 further secure piston 110 within cavity 109. Dual rubber boot sensor 100 connects to automatic driller 33 utilizing hydraulic line 111 and hydraulic line connector 112 which screws within blocks 101 and 104. Safety valve 113 fits between rubber boot 108 and hydraulic line connector 112 to remove the drilling fluid pressure signal from automatic driller 33 if excessive drilling fluid pressure builds up within drill string 21.

In operation, the drilling fluid contacts rubber boot 107 to force rubber boot 107 towards cylinder 110. Rubber boot 107 contacts cylinder 110 and forces it against rubber boot 108. In turn, cylinder 110 moves rubber boot 108 to displace the hydraulic fluid within hydraulic line 111. The pressure rubber boot 108 applies against the hydraulic fluid within hydraulic line 111 provides a signal corresponding to the drilling fluid pressure. Although the surface area of both sides of cylinder 110 may be equal to provide a one to one drilling fluid to hydraulic fluid pressure ratio, the surface area of the end of cylinder 110 contacting rubber boot 108 may be enlarged to provide a reduction in the measured pressure to actual fluid pressure ratio. Illustratively, the cylinder surface area ratio could be four to one to provide a one/fourth reduction between the drilling fluid pressure and the pressure of the hydraulic fluid within hydraulic line 111.

However, if excess drilling fluid pressure builds up in drill string 21, safety valve 113 will prevent rubber boot 108 from generating a signal to automatic driller 33. Specifically, rubber boot will rise within cavity 109 such that it forces safety valve 113 over the opening through hydraulic line connector 112, thereby blocking it. Consequently, rubber boot 108 will not exert any pressure on the hydraulic fluid within hydraulic line 111, and automatic driller 33 will not receive a signal. As a result, automatic driller 33 will not be damaged from overpressure.

Figure 5:
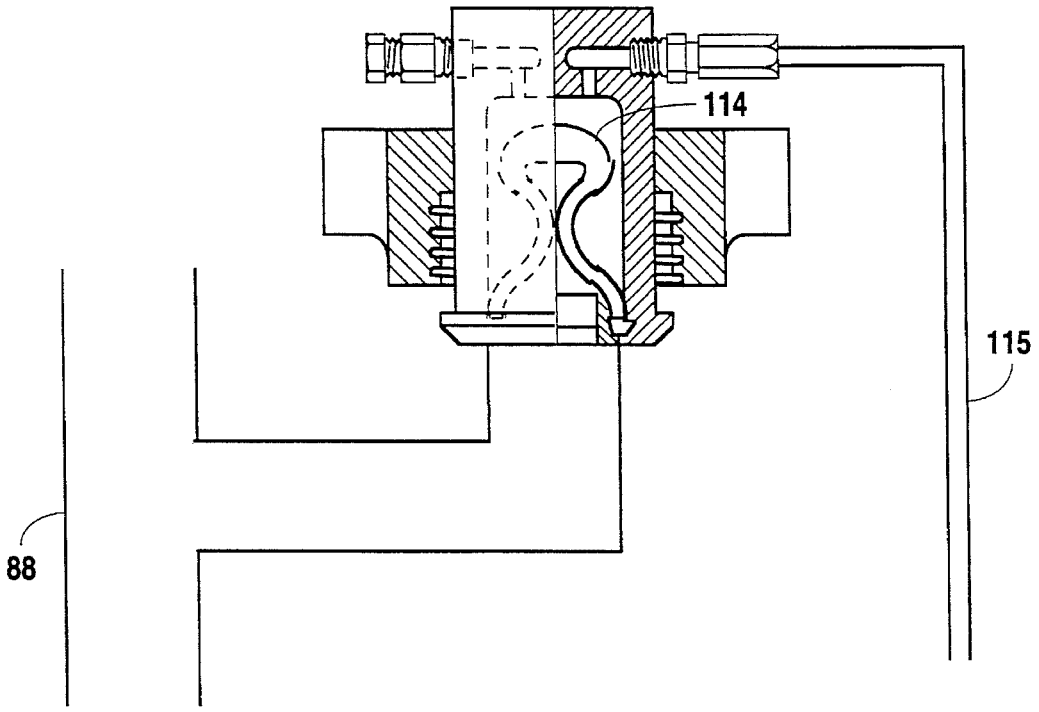
FIG. 5 is a front view in partial perspective depicting a pump fluid pressure sensor utilized in the automatic drilling system of the present invention.

Alternatively, a standard drilling fluid pressure sensor may be employed. Illustratively, FIG. 5 depicts a Martin-Decker mud pump pressure gauge which may be employed to supply automatic driller 33 with a signal indicative of drilling fluid pressure. The Martin-Decker mud pump pressure gauge includes diaphragm 114 which contacts the drilling fluid to exert a pressure against the hydraulic fluid within hydraulic line 115, thereby providing automatic driller 33 with a drilling fluid pressure signal.

Figure 6:
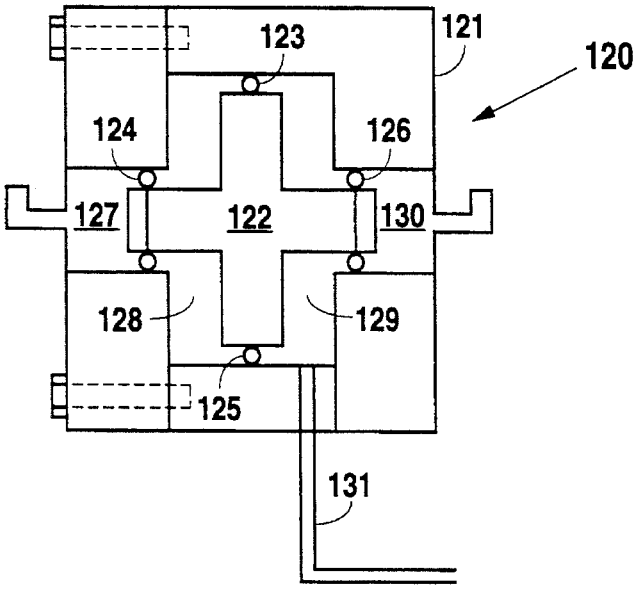
FIG. 6 is a cross-sectional front view depicting the well-head pressure compensation valve according to the preferred embodiment of the present invention.

FIG. 6 illustrates a wellhead pressure compensation valve that may be utilized in conjunction with either the drilling fluid pressure sensor of FIG. 4 or the standard drilling fluid pressure sensor of FIG. 5. Wellhead pressure compensation valve 120 provides a drilling fluid pressure signal to automatic driller 33 that incorporates changes in well head pressure as well as changes in the pressure of the drilling fluid within drill string 21. Well head pressure compensation valve 120 comprises enclosure 121 which encloses piston 122, which is cross-shaped in the preferred embodiment. O-rings 123–126 mount piston 122 within enclosure 121 and, further, divide the inner cavity of enclosure 121 into four individual cavities 127–130. Cavity 127 communicates with the hydraulic line 111 or hydraulic line 115, depending upon which drilling fluid pressure sensor is being used, in order to apply a drilling fluid pressure signal against piston 122. Cavity 130 communicates with the output of a pressure sensors mounted at the wellhead to apply a hydraulically conveyed wellhead pressure signal to piston 122. The pressure sensor at the wellhead may be of a type similar to those depicted in FIGS. 4 and 5. Air fills cavity 128 to allow the motion of piston 122 within enclosure 121, while hydraulic fluid fills cavity 129 to provide a hydraulic pressure signal to automatic driller 33 via hydraulic line 131. That hydraulic pressure signal corresponds to the difference between the drilling fluid pressure within drill string 21 and the drilling fluid pressure at the well head.

In operation, the hydraulic fluid pressure applied against piston 122 via cavities 127–130 balance against each other to provide a differential signal output representing changes in either the drilling fluid pressure within drill string 21 or at the well head. Illustratively, either an increase in the drilling fluid pressure within drill string 21 or the decrease of drilling fluid pressure at the well head will result in an increase in the pressure of the hydraulic fluid delivered to automatic driller 33. Alternatively, either a decrease in drilling fluid pressure within drill string 21 or an increase in drilling fluid pressure at the well head will result in a decrease in the hydraulic pressure signal delivered to automatic driller 33.

Figure 7:
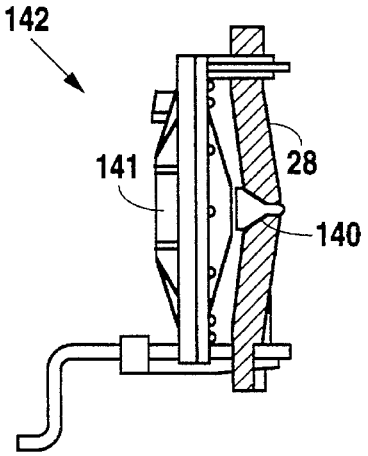
FIG. 7 is a side view depicting a drill line tension sensor utilized in the automatic drilling system of the present invention.
Figure 8:
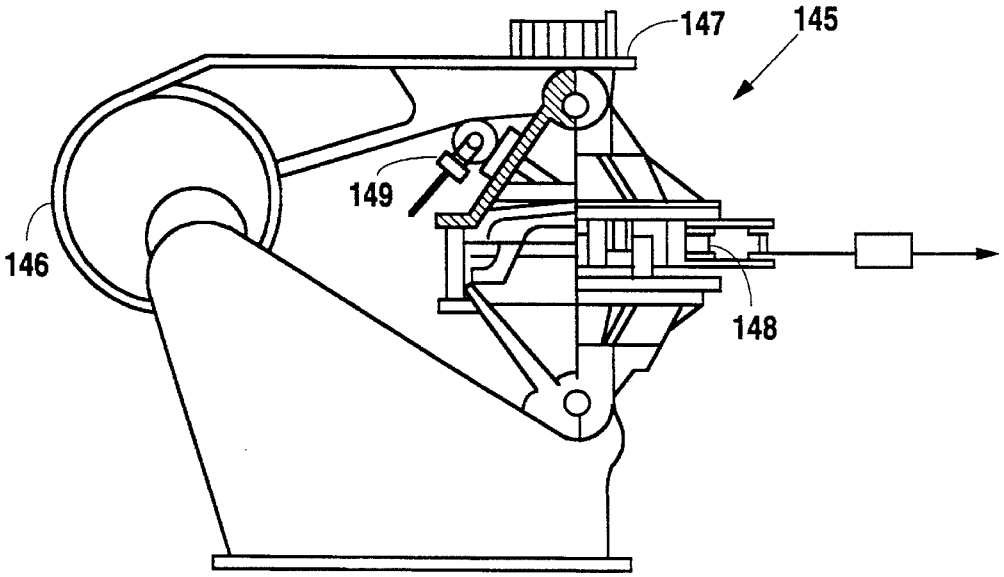
FIG. 8 is a side view depicting an alternative drill line tension sensor utilized in the automatic drilling system of the present invention.

FIGS. 7 and 8 illustrate two standard weight on bit sensors that may be utilized to supply a weight on bit signal to automatic driller 33. Specifically, FIG. 7 depicts a Martin-Decker clipper weight indicator that mounts onto cable 28 to provide a hydraulic signal representative of the weight drill string 21 applies on top of drill bit 23. A hydraulic hose (not shown) connects clipper weight indicator 142 to automatic driller 33 to provide automatic driller 33 with a hydraulic representation of the weight drill string 21 applies on bit 23. That is, cable 28 applies pressure against defection plug 140 which, in turn, applies pressure against diaphragm 141. As a result, diaphragm 141 contracts to pressurize the hydraulic fluid within the hydraulic hose to deliver a hydraulic pressure signal to automatic driller 33.

In FIG. 8, a Martin-Decker anchor weight indicator implements bit weight sensor 35 to provide the hydraulic signal to automatic driller 33 representing the weight drill string 21 applies to drill bit 23. Anchor weight indicator 145 also substitutes for cable drum anchor 27. That is, anchor weight indicator anchors cable 28 to drilling rig 10 with drilling cable drum 146. In operation, as the tension on cable 28 varies, arm 147 applies pressure to diaphragm 148 which, in turn, compresses hydraulic fluid within hydraulic line 149 to supply a hydraulic fluid signal to automatic driller 33 via hydraulic line 149.

Figure 10:
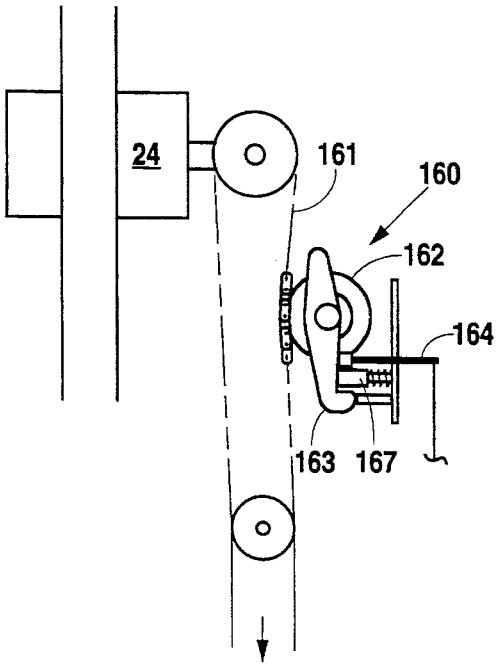
FIG. 10 is a schematic diagram depicting a pipe rotation torque sensor utilized in the automatic drilling system of the present invention.

FIG. 10 illustrates a Martin-Decker idler wheel tension sensor utilized to provide automatic driller 33 with a hydraulic signal indicating drill string torque. Idler wheel tension sensor 160 is utilized when a power source such as a diesel engine drives rotary table 24 (See FIG. 1). Idler wheel tension sensor 160 mounts against drive chain 161 such that wheel 162 abuts drive chain 161. Thus, as drive chain 161 rotates, wheel 162 rotates to apply downward tension pressure against idler arm 163 which, in turn, applies pressure to hydraulic cylinder 167, thereby increasing the fluid pressure within hydraulic fluid line 164. Hydraulic fluid line 164 connects to automatic driller 33 to provide automatic driller 33 with a hydraulic signal representing drill string torque.

Figure 11:
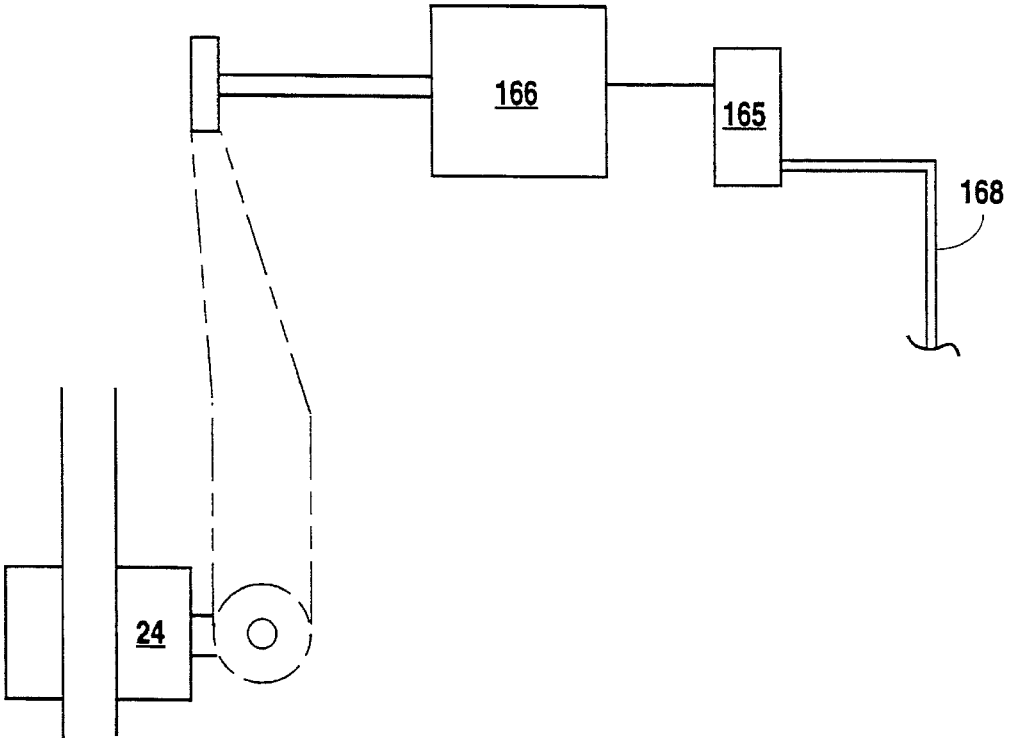
FIG. 11 is a schematic diagram depicting an alternative pipe rotation torque sensor utilized in the automatic drilling system of the present invention.

FIG. 11 illustrates a drill string torque sensor utilized when an electric motor drives rotary table 24 (See. FIG. 1). Specifically, electrical to pneumatic transducer 165 connects to electric motor 166. As electric motor 166 operates, it generates an electrical current that feeds into electrical to pneumatic transducer 165. Electrical to pneumatic transducer 165 converts that current signal into a pneumatic signal which it delivers to automatic driller 33 via pneumatic hose 168. The pneumatic signal supplied to automatic driller 33 by electrical to pneumatic transducer 165 corresponds to the torque rotary table 24 applies to drill string 21.

Figure 12:
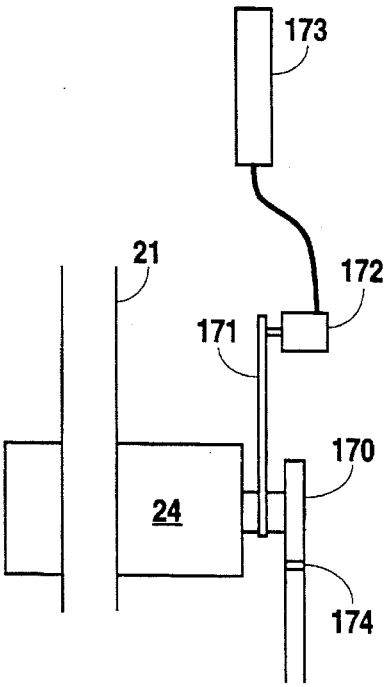
FIG. 12 is a schematic diagram depicting a pipe RPM sensor utilized in the automatic drilling system of the present invention.

FIG. 12 illustrates a drill string RPM sensor utilized to provide automatic driller 33 with a signal indicative of drill string RPM when a power source such as a diesel engine or electric motor drives rotary table 24 via gear 170. V-belt 171 couples generator 172 to gear shaft 170 to drive generator 172 in unison with gear 170. As a result, generator 172 generates a voltage signal that it supplies to electrical to pneumatic transducer 173. Electrical to pneumatic transducer 173 converts that voltage signal to a pneumatic signal which it then supplies to automatic driller 33 to provide automatic driller 33 with the RPM of drill string 21.

Figure 13:
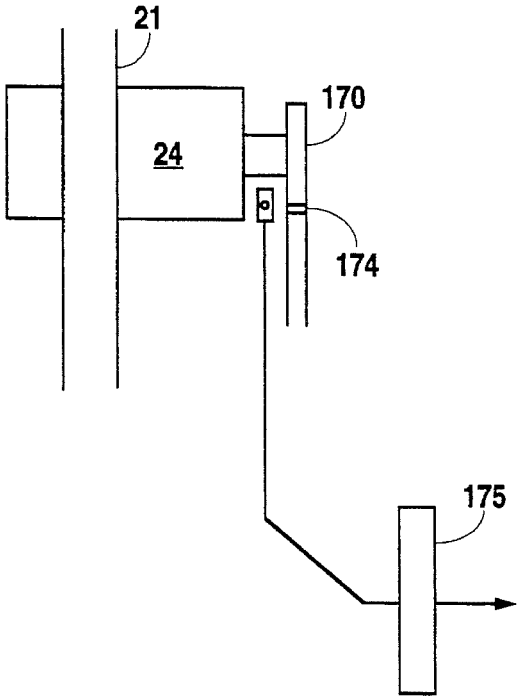
FIG. 13 is a schematic diagram depicting an alternative pipe RPM sensor utilized in the automatic drilling system of the present invention.

FIG. 13 illustrates an alternate drill string RPM sensor which provides automatic driller with a signal representing drill string RPM when either a diesel engine or electric motor drives rotary table 24 via gear 170. Proximity switch 174 develops an electrical signal that corresponds to the speed with which rotary table 24 rotates drill string 21. Electrical to pneumatic transducer 175 receives that electrical signal and converts it into a pneumatic signal representing drill string RPM. Electrical to pneumatic transducer 175 connects to automatic driller 33 to provide automatic driller 33 with a pneumatic signal representing drill string RPM.

Figure 2:
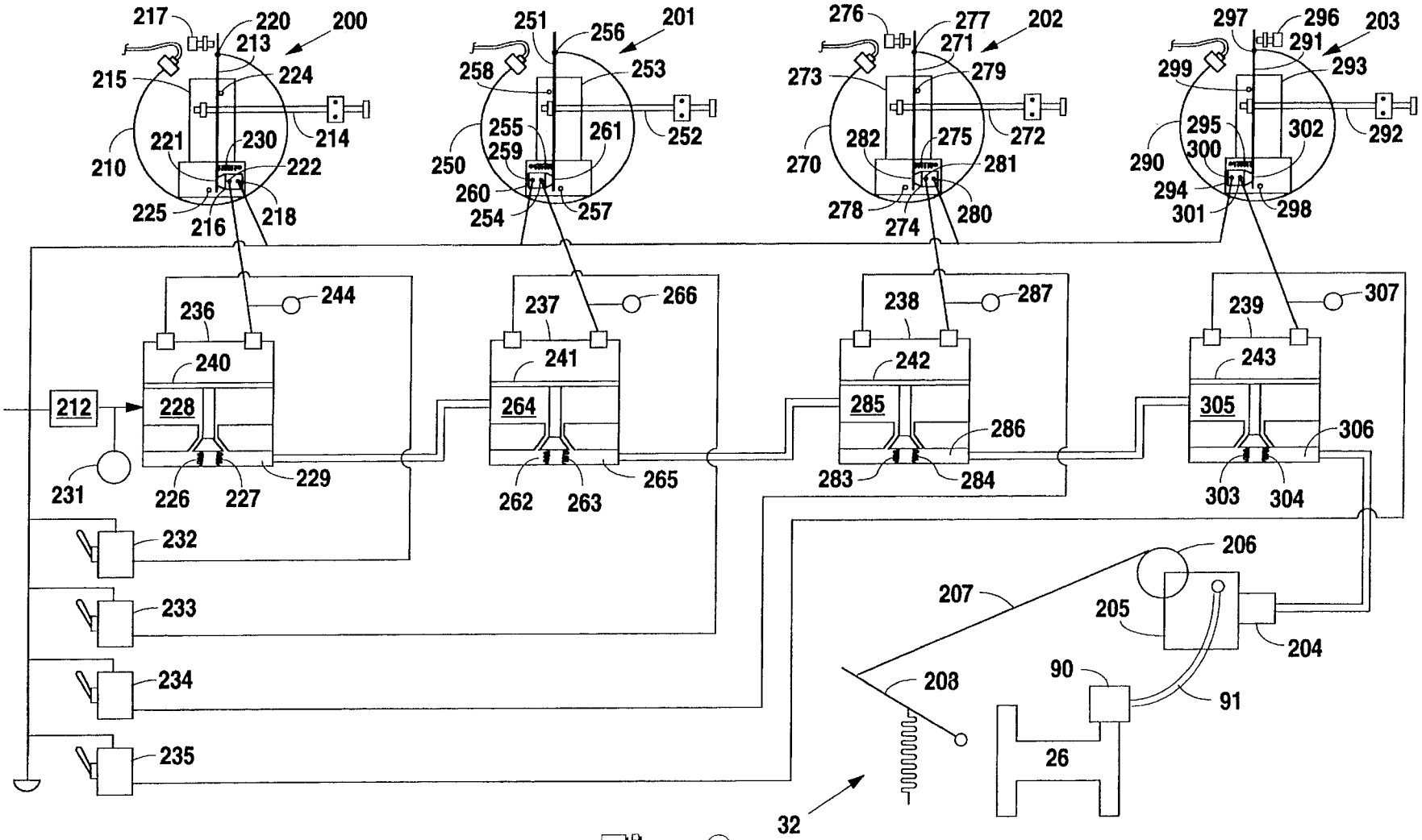
FIG. 2 is a schematic diagram depicting the automatic drilling system according to the preferred embodiment of the present invention.

As shown in FIG. 2, automatic driller 33 comprises drilling fluid pressure regulator 200, bit weight regulator 201, drill string torque regulator 202, and drill string RPM regulator 203 which receive the drilling signals developed by drilling fluid pressure sensor 34, bit weight sensor 35, drill string torque sensor 36, and drill string RPM sensor 37, respectively. Automatic driller 33 further comprises air motor 204 which drives differential gear unit 205. Differential gear unit 205 manipulates cable reel 206 to raise and lower brake handle 208 via cable 207, thereby adjusting the braking force brake 32 applies against drum 26. Regulators 200–203 connect to valves 236–239, respectively, to output a pneumatic signal to air motor 204 which drives air motor 204 to control brake 32 and, thus, the release of cable 28 from drum 26. Although regulators 200–203 may be used concurrently to control brake 32, they may also be utilized individually or in any combination to control the release of cable 28 from drum 26.

In the preferred embodiment, valves 236–239 are pneumatic valves that operate as relays to supply compressed air to air motor 204. Specifically, valves 236–239 connect in series to deliver compressed air from an air supply (not shown) to air motor 204. That is, the air supply delivers the compressed air to valve 236 through flow regulator 212. Air pressure gauge 231 registers the air pressure supplied to valve 236 and displays that value for the automatic driller operator. Flow regulator 212 functions to limit the pressure of the compressed air delivered to valve 236 and, thus, the maximum rate at which air motor 204 will drive cable reel 206. Flow regulator 212, therefore, determines the maximum rate at which drill bit 23 could penetrate into formation 87.

Valve selectors 232–235 control which ones of regulators 200–203 control the drilling operation. That is, if all four regulators are to control the drilling operation, valve selectors 232–235 remain on so that regulators 200–203 control the delivery of compressed air from their respective valves 236–239. However, if, for example, only drilling fluid pressure regulator 200 is to control the drilling operation, valve selector 232 remains switched on while valve selectors 233–235 are switched off. In its on position, valve selector 232 continues to prevent the air supply from delivering compressed air directly onto diaphragm 240 of valve 236 so that drilling fluid regulator 200 controls the opening and closing of valve 236. Conversely, with valve selectors 233–235 switched off, they allow the air supply to deliver compressed air directly onto diaphragms 241–243 of valves 237–239. As a result, valves 237–239 fully open and function only to pass the flow of compressed air regulated by drilling fluid pressure regulator 200. That is, bit weight regulator 201, drill string torque regulator 202, and drill string RPM regulator 203 remain off and do not regulate the supply of compressed air delivered to air motor 204. Valve selectors 232–235 may be manipulated in any combination so that any one, any combination, or all of regulators 200–203 regulate the delivery of compressed air to air motor 204.

Figure 3:
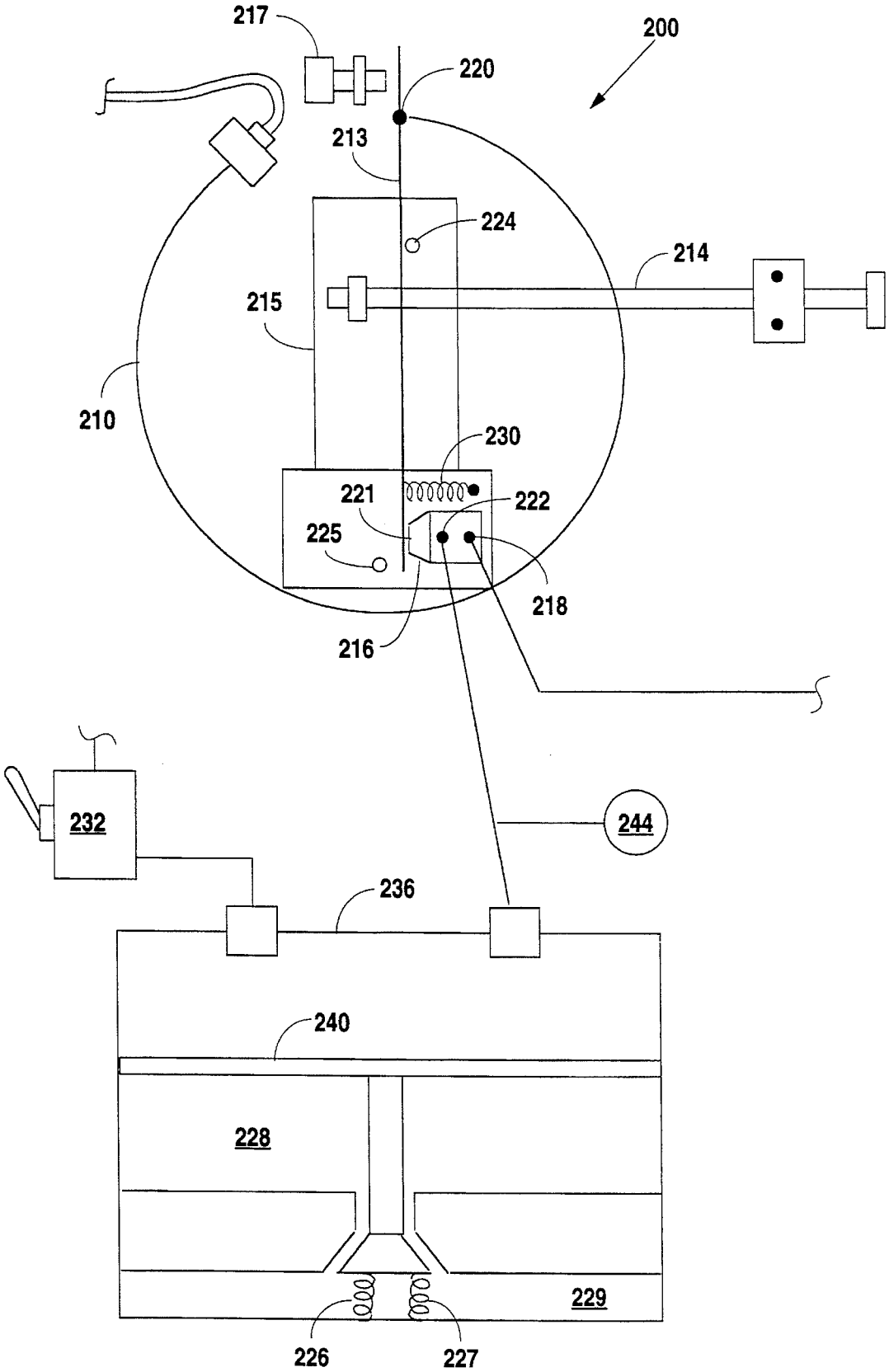
FIG. 3 is an enlarged view of the pump pressure regulator of the automatic drilling system depicted in FIG. 2.

FIG. 3 depicts an enlarged view of drilling fluid pressure regulator 200 and will be referenced to provide an illustration of the use of regulators 200–203 in automatic driller 33. Specifically, drilling fluid pressure regulator 200 measures changes in drilling fluid pressure to regulate a drilling operation. As previously described, valve selector 232 remains on, and valve selectors 233–235 are switched off so that only drilling fluid pressure regulator 200 regulates the flow of compressed air from the air supply to air motor 204. Drilling fluid pressure regulator 200 ensures drill bit 23 progresses through formation 87 at an optimal rate of penetration by maintaining the drilling fluid within drill string 21 at an optimal pressure. As long as the drilling fluid remains at that optimal pressure, drill bit 23 will reside "on bottom" with sufficient bit weight to drill borehole 86 through formation 87. Drilling fluid pressure regulator 200 regulates drilling fluid pressure by releasing cable 28 from drum 26 in response to decreases in drilling fluid pressure. The release of cable lowers drill string 21 to place drill bit 23 "on bottom". With drill bit 23 "on bottom", backpressure created within drill string 21 raises drilling fluid pressure back to its optimal value. Once drilling fluid pressure reaches its optimal value, drilling fluid pressure regulator 200 stops the release of cable 28 to end the lowering of drill string 21.

Drilling fluid pressure regulator 200 includes Bourdon tube 210 which connects to drilling fluid pressure sensor 34 to sense changes in drilling fluid pressure within drill string 21 and to control valve 236 accordingly. Drilling fluid pressure regulator 200 further includes flapper 213, adjusting screw 214, plate 215, nozzle 216, spring 230, and safety shut-down knob 217. Flapper 213 connects to one end of Bourdon tube 210 with pivot screw 220, while spring 230 connects to plate 215 and flapper 213 in order to provide a restoring force that maintains flapper 213 near nozzle 216. Nozzle 216 mounts on plate 215 to deliver variable amounts of compressed air from the air supply to diaphragm 240 of valve 236 in response to changes in drilling fluid pressure. Adjusting screw 214 connects to plate 215 in order to adjust plate 215 transverse to flapper 213 about pivot screw 225. That is, adjusting screw 214 swings the top of plate 215 in an arc about pivot screw 225 to position nozzle 216 either closer or further from flapper 213. In addition, plate 215 includes pivot pin 224 which provides the pivot point for flapper 213.

In normal operation, Bourdon tube 210 manipulates flapper 213 in response to changes in drilling fluid pressure to vary the amount of compressed air nozzle 216 delivers to valve 236. That variable amount of compressed air alters the opening of valve 236 and, thus, the force with which the compressed air drives air motor 204. However, before drilling fluid regulator 200 will automatically regulate drilling fluid pressure, nozzle 216 and flapper 213 must be calibrated to supply a driller operator selected amount of compressed air to valve 236.

To calibrate drilling fluid pressure regulator 200 and automatically regulate drilling fluid pressure, the drilling rig operators must first manually manipulate brake 32 to place drill bit 23 "on bottom". Once drill bit 23 resides "on bottom", the drilling rig operators connect cable 207 to brake handle 208. Adjustment screw 214 must then be adjusted to move nozzle 216 relative to flapper 213 so that it will deliver compressed air to valve 236. The delivery of compressed air by nozzle 216 opens valve 236, thereby allowing the actuation of air motor 204.

If adjustment screw 214 and, thus, nozzle 216 remain unadjusted, drilling fluid pressure regulator 200 will not maintain a constant drilling fluid pressure. Specifically, flapper 213 diverts no compressed air into orifice 222, and all the compressed air flowing into nozzle 216 through orifice 218 exhausts through nozzle outlet 221. Orifice 222, therefore, delivers no compressed air over top of diaphragm 240 which results in valve 236 remaining closed. With valve 236 closed, air motor 204 receives no compressed air causing brake 32 to remain engaged. Consequently, drum 26 does not release cable 28 which results in drill bit 23 rising "off bottom". Thus, nozzle 216 must be adjusted to deliver the drilling rig operator selected amount of air pressure to air motor 204 so that optimal drilling fluid pressure will be maintained within drill string 21.

Adjusting screw 214 threadably connects to plate 215 in order to adjust plate 215 and, thus, nozzle 216 transverse to flapper 213. As a drilling rig operator tightens adjusting screw 214, plate 215 pivots from right to left about pivot screw 225. That is, adjusting screw 214 swings the top of plate 215 in an arc from right to left about pivot screw 225 to position nozzle 216 closer to flapper 213. As a result, flapper 213 deflects the flow of compressed air from nozzle outlet 221 into orifice 222 which delivers the compressed air to valve 236. The diversion of the compressed air into valve 236 drives diaphragm 240 down to compress springs 226 and 227 and open valve 236. The loosening of adjusting screw 214 moves nozzle 216 away from flapper 213 to reduce or eliminate the diversion of compressed air into valve 236.

The opening of valve 236 allows compressed air from the air supply to flow from cavity 228 into cavity 229 and out from valve 236 into valve 237. The compressed air then flows through valves 237–239 to air motor 204 because valves 237–239 were previously opened by valve selectors 233–235. The compressed air entering air motor 204 activates it and begins it rotating. As air motor 204 rotates, differential gear unit 205 transfers that motion to cable wheel 206 which picks up brake handle 32 via cable 207 to lessen the braking force brake 32 exerts on drum 26. Consequently, drum 26 releases cable 28 to place more weight of drill string 21 on drill bit 23 causing an increase in drilling fluid pressure.

A drilling rig operator tightens adjusting screw 214 to cause the release of drill string 21 until the drilling fluid within drill string 21 reaches its desired pressure. Drilling fluid pressure gauge 80 (see FIG. 1) registers and displays the pressure of the drilling fluid within drill string 21 for the drilling rig operator. Accordingly, when drilling fluid pressure gauge 80 registers the desired drilling fluid pressure, the drilling rig operator stops tightening adjusting screw 214. Alternatively, pneumatic pressure gauge 244 registers and displays the pressure of the compressed air nozzle 216 delivers to valve 236. Thus, when pneumatic pressure gauge 244 registers the desired compressed air pressure and, thus, the desired opening of valve 236, the drilling rig operator stops tightening adjusting screw 214.

With adjusting screw 214 no longer being tightened, the amount of compressed air valve 236 delivers to air motor 204 stabilizes to a constant amount. As a result, air motor 204 maintains brake 32 engaged against drum 26 at a constant force. Consequently, drum 26 will release cable 28 slowly so that drill string 21 will maintain a bit weight sufficient to sustain the pressure of the drilling fluid within drill string 21 at its optimal pressure.

At this point, drill bit 23 should progress through formation 87 at the optimal rate of penetration. Unfortunately, even under optimal drilling conditions drill bit 23 will rise "off bottom", thus requiring drilling fluid pressure regulator 200 to readjust the release of cable 28 from drum 26. Any time drill bit 23 rises even slightly "off bottom", drilling fluid pressure within drill string 21 decreases. Drilling fluid pressure sensor 34 measures that decrease and supplies Bourdon tube 210 with a hydraulic signal representing that decrease. Any decrease in drilling fluid pressure registered by Bourdon tube 210 causes it to contract. As Bourdon tube 210 contracts, it drives flapper 213 to the left via its connection to flapper 213 at pivot screw 220. As flapper 213 moves left at pivot screw 220, its center point pivots about pin 224 to drive its opposite end towards nozzle outlet 221. The pivoting of flapper 213 to a position closer to nozzle 216 restricts additional compressed air flow from nozzle outlet 221 and redirects that compressed air flow into orifice 222. Orifice 222 delivers the compressed air to the top of diaphragm 240, thereby further opening valve 236. With valve 236 opened further, air motor 204 receives an additional amount of compressed air which increases the speed with which it rotates. In response, cable reel 206 raises brake handle 208 causing brake 32 to further disengage from drum 26. Consequently, drum 26 releases cable 28 an additional amount, thus lowering drill string 21. Drum 26 lowers drill string 21 until drill bit 23 again resides "on bottom" so that an increase in the pressure of the drilling fluid within drill string 21 may be effected.

As the drilling fluid pressure returns to its optimal value, drilling fluid pressure sensor 34 registers that increase and supplies Bourdon tube 210 with a hydraulic signal representing that increase. The increasing hydraulic fluid pressure within Bourdon tube 210 causes it to expand and pull flapper 213 to the right via its connection to flapper 213 at pivot screw 220. With flapper 213 pivoting to the right at pivot screw 220, its center pivots about pin 224 to drive its opposite end to the left, thereby moving it further from nozzle outlet 221. As a result, orifice 222 delivers less compressed air over top of diaphragm 240, while nozzle outlet 221 exhausts more compressed air. Consequently, valve 236 closes slightly to deliver less compressed air to air motor 204 causing it to rotate more slowly. In response, differential gear unit 205 releases cable reel 206 so that brake handle 208 lowers. Differential gear unit 205 includes a first shaft connected to cable reel 206 and a second shaft connected to wheel drum rotation sensor 90 via flexible shaft cable 91. Wheel drum rotation sensor 90 senses the rotation of drum 26 and transfers that rotation to the second shaft of differential gear unit 205 via flexible cable shaft 91. Accordingly, with air motor 204 rotating more slowly than drum 26, the second shaft speeds up relative to the first shaft resulting in the first shaft slowing down even further. The slowing down of the first shaft removes the driving force from cable reel 206, thus allowing it to unspool cable 207 to lower brake handle 208. With brake handle 208 lowered, brake 32 increases its braking of drum 26, resulting in the release of cable 28 slowing to its calibrated value.

Safety shut-down knob 217 functions to prevent drilling fluid pressure regulator 200 from releasing drill string 21 during either a drilling rig malfunction or dangerous drilling conditions. As previously described, drilling fluid pressure regulator 200 will release drill string 21 when it senses a decrease in drilling fluid pressure. Unfortunately, not every decrease in drilling fluid pressure should result in the release of drill string 21. For example, if drilling fluid pump 25 stops pumping, drill string 21 breaks, or drill bit 23 enters a cavern, drilling fluid pressure will decrease, however, drilling fluid pressure regulator 200 should not release drill string 21. The release of drill string 21 under such conditions could damage drilling rig 10 or create a situation where injury to the drilling rig operators could occur.

In the event of a large decrease in drilling fluid pressure, safety shut-down knob 217 pivots flapper 213 from nozzle outlet 221. That is, under normal operation, Bourdon tube 210 pivots flapper 213 towards nozzle 216, thus causing nozzle 216 to open valve 236 further. However, if drilling fluid pressure drops below an operator set minimum, Bourdon tube 210 will push flapper 213 against safety shut-down knob 217. As Bourdon tube 210 pushes flapper 213 against safety shut-down knob 217, flapper 213 rotates in an arc to the right about pivot screw 220. As a result, the opposite end of flapper 213 pivots away from nozzle outlet 221 to allow nozzle outlet 221 to exhaust all the compressed air delivered from the air supply to nozzle 216. Accordingly, nozzle 216 delivers no compressed air to valve 236, and valve 236 closes. With valve 236 closed, air motor 204 shuts off to stop the release of cable 28 from drum 26, thereby ending the drilling operation.

As shown in FIG. 2, bit weight regulator 201 may be utilized to control a drilling operation. Specifically, bit weight regulator 201 measures changes in bit weight to regulate the rate at which drill bit 23 penetrates formation 87. For bit weight regulator 201 to control the drilling operation, valve selector 233 must be switched on, and valve selectors 232, 234, and 235 must be switched off so that only bit weight regulator 201 regulates the flow of compressed air from the air supply to air motor 204. Bit weight regulator 201 ensures drill bit 23 progresses through formation 87 at an optimal rate of penetration by maintaining the weight drill string 21 applies to drill bit 23 at an optimal weight. As long as drill string 21 applies that optimal weight, drill bit 23 will reside "on bottom" with sufficient bit weight to drill borehole 86 through formation 87. Bit weight regulator 201 regulates bit weight by releasing cable 28 from drum 26 in response to hook load weight (i.e. tension) increases experienced by cable 28. The release of cable 28 lowers drill string 21 to place drill bit 23 "on bottom", thereby reducing the hook load weight of cable 28. Drum 26 continues to release cable 28 until the weight drill string 21 applies to drill bit returns to its optimal value. Once the weight drill string 21 applies to drill bit 23 reaches its optimal value, bit weight regulator 201 stops the release of cable 28 to end the lowering of drill string 21.

Bit weight regulator 201 includes Bourdon tube 250 which connects to bit weight sensor 35 to sense changes in bit weight and to control valve 237 accordingly. Bit weight regulator 201 further includes flapper 251, adjusting screw 252, plate 253, nozzle 254, and spring 255. Flapper 251 connects to one end of Bourdon tube 250 with pivot screw 256, while spring 255 connects to plate 253 and flapper 251 in order to provide a restoring force that maintains flapper 251 near nozzle 254. Nozzle 254 mounts on plate 253 to deliver variable amounts of compressed air from the air supply to diaphragm 241 of valve 237 in response to changes in bit weight. Adjusting screw 252 connects to plate 253 in order to adjust plate 253 transverse to flapper 251 about pivot screw 257. That is, adjusting screw 252 swings the top of plate 253 in an arc about pivot screw 257 to position nozzle 254 either closer or further from flapper 251. In addition, plate 253 includes pivot pin 258 which provides the pivot point for flapper 251.

In normal operation, Bourdon tube 250 manipulates flapper 251 in response to changes in bit weight to vary the amount of compressed air nozzle 254 delivers to valve 237. That variable amount of compressed air alters the opening of valve 237 and, thus, the force with which the compressed air drives air motor 204. However, before drilling fluid regulator 200 will automatically regulate bit weight, nozzle 254 and flapper 251 must be calibrated to supply a driller operator selected amount of compressed air to valve 237.

To calibrate bit weight regulator 201 and automatically regulate bit weight, the drilling rig operators must first manually manipulate brake 32 to place drill bit 23 "on bottom". Once drill bit 23 resides "on bottom", the drilling rig operators connect cable 207 to brake handle 208. Adjustment screw 252 must then be adjusted to move nozzle 254 relative to flapper 251 so that it will deliver compressed air to valve 237. The delivery of compressed air by nozzle 254 opens valve 237, thereby allowing the actuation of air motor 204.

If adjustment screw 252 and, thus, nozzle 254 remain unadjusted, bit weight regulator 201 will not maintain a constant bit weight. Specifically, flapper 251 diverts no compressed air into orifice 260, and all the compressed air flowing into nozzle 254 through orifice 259 exhausts through nozzle outlet 261. Orifice 260, therefore, delivers no compressed air over top of diaphragm 241 which results in valve 237 remaining closed. With valve 237 closed, air motor 204 receives no compressed air causing brake 32 to remain engaged. Consequently, drum 26 does not release cable 28 which results in drill bit 23 rising "off bottom". Thus, nozzle 254 must be adjusted to deliver the drilling rig operator selected amount of air pressure to air motor 204 so that optimal bit weight will be maintained.

Adjusting screw 252 threadably connects to plate 253 in order to adjust plate 253 and, thus, nozzle 254 transverse to flapper 251. As a drilling rig operator loosens adjusting screw 252, plate 253 pivots from left to right about pivot screw 257. That is, adjusting screw 252 swings the top of plate 253 in an arc from left to right about pivot screw 257 to position nozzle 254 closer to flapper 251. As a result, flapper 251 deflects the flow of compressed air from nozzle outlet 261 into orifice 260 which delivers the compressed air to valve 237. The diversion of the compressed air into valve 237 drives diaphragm 241 down to compress springs 262 and 263 and open valve 237. The tightening of adjusting screw 252 moves nozzle 254 away from flapper 251 to reduce or eliminate the diversion of compressed air into valve 237.

The opening of valve 237 allows compressed air from the air supply to flow from cavity 264 into cavity 265 and out from valve 237 into valve 238. Compressed air initially flows to valve 237 because valve selector 232 locks valve 236 open. The compressed air flows from valve 237 through valves 238 and 239 to air motor 204 because valves 238 and 239 were previously opened by valve selectors 234 and 235. The compressed air entering air motor 204 activates it and begins it rotating. As air motor 204 rotates, differential gear unit 205 transfers that motion to cable wheel 206 which picks up brake handle 32 via cable 207 to lessen the braking force brake 32 exerts on drum 26. Consequently, drum 26 releases cable 28 to place more weight of drill string 21 on drill bit 23.

A drilling rig operator loosens adjusting screw 252 to cause the release of drill string 21 until drill string 21 resides on drill bit 23 at the desired weight. Drill string weight gauge 81 (see FIG. 1) registers and displays the weight drill string 21 applies on top of drill bit 23 for the drilling rig operator. Accordingly, when drill string weight gauge 81 registers the desired bit weight, the drilling rig operator stops loosening adjusting screw 252. Alternatively, pneumatic pressure gauge 266 registers and displays the pressure of the compressed air nozzle 254 delivers to valve 237. Thus, when pneumatic pressure gauge 266 registers the desired compressed air pressure and, thus, the desired opening of valve 237, the drilling rig operator stops loosening adjusting screw 252.

With adjusting screw 252 no longer being loosened, the amount of compressed air valve 237 delivers to air motor 204 stabilizes to a constant amount. As a result, air motor 204 maintains brake 32 engaged against drum 26 at a constant force. Consequently, drum 26 will release cable 28 slowly so that drill string 21 will maintain it optimal bit weight.

At this point, drill bit 23 should progress through formation 87 at the optimal rate of penetration. Unfortunately, even under optimal drilling conditions drill bit 23 will rise "off bottom", thus requiring bit weight regulator 201 to readjust the release of cable 28 from drum 26. Any time drill bit 23 rises even slightly "off bottom", the hook load experienced by cable 28 increases. That is, the tension within cable 28 increases. Bit weight sensor 35 measures that increase and supplies Bourdon tube 250 with a hydraulic signal representing that increase. Any increase in hook load registered by Bourdon tube 250 causes it to expand. As Bourdon tube 250 expands, it pulls flapper 251 to the right via its connection to flapper 251 at pivot screw 256. As flapper 251 moves right at pivot screw 256, its center point pivots about pin 258 to drive its opposite end towards nozzle outlet 261. The pivoting of flapper 251 to a position closer to nozzle 254 restricts additional compressed air flow from nozzle outlet 261 and redirects that compressed air flow into orifice 260. Orifice 260 delivers the compressed air to the top of diaphragm 241, thereby further opening valve 237. With valve 237 opened further, air motor 204 receives an additional amount of compressed air which increases the speed with which it rotates. In response, cable reel 206 raises brake handle 208 causing brake 32 to further disengage from drum 26. Consequently, drum 26 releases cable 28 an additional amount, thus lowering drill string 21. Drum 26 lowers drill string 21 until drill bit 23 again resides "on bottom" so that an increase in the weight drill string 21 applies onto drill bit 23 may be effected.

As the weight drill string applies onto drill bit 23 returns to its optimal value, bit weight sensor 35 registers the decrease in hook load (i.e. tension) experienced by cable 28 and supplies Bourdon tube 250 with a hydraulic signal representing that decrease. The decreasing hydraulic fluid pressure within Bourdon tube 250 causes it to retract and push flapper 251 to the left via its connection to flapper 251 at pivot screw 256. With flapper 251 pivoting to the left at pivot screw 256, its center pivots about pin 258 to drive its opposite end to the right, thereby moving it further from nozzle outlet 261. As a result, orifice 260 delivers less compressed air over top of diaphragm 241, while nozzle outlet 261 exhausts more compressed air. Consequently, valve 237 closes slightly to deliver less compressed air to air motor 204 causing it to rotate more slowly. In response, differential gear unit 205 releases cable reel 206 so that brake handle 208 lowers. Differential gear unit 205 includes a first shaft connected to cable reel 206 and a second shaft connected to wheel drum rotation sensor 90 via flexible shaft cable 91. Wheel drum rotation sensor 90 senses the rotation of drum 26 and transfers that rotation to the second shaft of differential gear unit 205 via flexible cable shaft 91. Accordingly, with air motor 204 rotating more slowly than drum 26, the second shaft speeds up relative to the first shaft resulting in the first shaft slowing down even further. The slowing down of the first shaft removes the driving force from cable reel 206, thus allowing it to unspool cable 207 to lower brake handle 208. With brake handle 208 lowered, brake 32 increases its braking of drum 26, resulting in the release of cable 28 slowing to its calibrated value.

As shown in FIG. 2, drill string torque regulator 202 may be utilized to control a drilling operation. Specifically, drill string torque regulator 202 measures changes in drill string torque to regulate the rate at which drill bit 23 penetrates formation 87. For drill string torque regulator 202 to control the drilling operation, valve selector 234 must be switched on, and valve selectors 232, 233, and 235 must be switched off so that only drill string torque regulator 202 regulates the flow of compressed air from the air supply to air motor 204. Drill string torque regulator 202 ensures drill bit 23 progresses through formation 87 at an optimal rate of penetration by maintaining drill string torque at an optimal level. As long as drill string torque remains at that optimal level, drill bit 23 will reside "on bottom" with sufficient bit weight to drill borehole 86 through formation 87. Drill string torque regulator 202 regulates drill string torque by releasing cable 28 from drum 26 in response to changes in drill string torque. The release of cable 28 lowers drill string 21 to place drill bit 23 "on bottom". With drill bit 23 "on bottom", the torque drill string 21 applies to drill bit 23 increases to its optimal value. Once the torque of drill string 21 reaches its optimal value, drill string torque regulator 202 stops the release of cable 28 to end the lowering of drill string 21.

Drill string torque regulator 202 includes Bourdon tube 270 which connects to drill string torque sensor 36 to sense changes in drill string 21 torque and to control valve 238 accordingly. Drill string torque regulator 202 further includes flapper 271, adjusting screw 272, plate 273, nozzle 274, spring 275, and safety shut-down knob 276. Flapper 271 connects to one end of Bourdon tube 270 with pivot screw 277, while spring 275 connects to plate 273 and flapper 271 in order to provide a restoring force that maintains flapper 271 near nozzle 274. Nozzle 274 mounts on plate 273 to deliver variable amounts of compressed air from the air supply to diaphragm 242 of valve 238 in response to changes in drill string torque. Adjusting screw 272 connects to plate 273 in order to adjust plate 273 transverse to flapper 271 about pivot screw 278. That is, adjusting screw 272 swings the top of plate 273 in an arc about pivot screw 278 to position nozzle 274 either closer or further from flapper 271. In addition, plate 273 includes pivot pin 279 which provides the pivot point for flapper 271.

In normal operation, Bourdon tube 270 manipulates flapper 271 in response to changes in drill string torque to vary the amount of compressed air nozzle 274 delivers to valve 238. That variable amount of compressed air alters the opening of valve 238 and, thus, the force with which the compressed air drives air motor 204. However, before drill string torque regulator 202 will automatically regulate drill string torque, nozzle 274 and flapper 271 must be calibrated to supply a driller operator selected amount of compressed air to valve 238.

To calibrate drill string torque regulator 202 so that it automatically regulates drill string torque, the drilling rig operators must first manually manipulate brake 32 to place drill bit 23 "on bottom". Once drill bit 23 resides "on bottom", the drilling rig operators connect cable 207 to brake handle 208. Adjustment screw 272 must then be adjusted to move nozzle 274 relative to flapper 271 so that it will deliver compressed air to valve 238. The delivery of compressed air by nozzle 274 opens valve 238, thereby allowing the actuation of air motor 204.

If adjustment screw 272 and, thus, nozzle 274 remain unadjusted, drill string torque regulator 202 will not maintain a constant drill string torque. Specifically, flapper 271 diverts no compressed air into orifice 281, and all the compressed air flowing into nozzle 274 through orifice 280 exhausts through nozzle outlet 282. Orifice 281, therefore, delivers no compressed air over top of diaphragm 242 which results in valve 238 remaining closed. With valve 238 closed, air motor 204 receives no compressed air, causing brake 32 to remain engaged. Consequently, drum 26 does not release cable 28 which results in drill bit 23 rising "off bottom". Thus, nozzle 274 must be adjusted to deliver the drilling rig operator selected amount of air pressure to air motor 204 so that optimal drill string torque will be maintained.

Adjusting screw 272 threadably connects to plate 273 in order to adjust plate 273 and, thus, nozzle 274 transverse to flapper 271. As a drilling rig operator tightens adjusting screw 272, plate 273 pivots from right to left about pivot screw 278. That is, adjusting screw 272 swings the top of plate 273 in an arc from right to left about pivot screw 278 to position nozzle 274 closer to flapper 271. As a result, flapper 271 deflects the flow of compressed air from nozzle outlet 282 into orifice 281 which delivers the compressed air to valve 238. The diversion of the compressed air into valve 238 drives diaphragm 242 down to compress springs 283 and 284 and open valve 238. The loosening of adjusting screw 272 moves nozzle 274 away from flapper 271 to reduce or eliminate the diversion of compressed air into valve 238.

The opening of valve 238 allows compressed air from the air supply to flow from cavity 285 into cavity 286 and out from valve 238 into valve 239. Compressed air initially flows to valve 238 because valve selectors 232 and 233 lock valves 236 and 237 open. The compressed air flows from valve 238 through valves 239 to air motor 204 because valves 239 was also previously opened by valve selector 235. The compressed air entering air motor 204 activates it and begins it rotating. As air motor 204 rotates, differential gear unit 205 transfers that motion to cable reel 206 which picks up brake handle 32 via cable 207 to lessen the braking force brake 32 exerts on drum 26. Consequently, drum 26 releases cable 28 to place more weight of drill string 21 on drill bit 23 causing an increase in the amount of torque drill string 21 applies to drill bit 23.

A drilling rig operator tightens adjusting screw 272 to cause the release of drill string 21 until the torque drill string 21 applies to drill bit 23 reaches its desired level. Drill string torque gauge 82 (see FIG. 1) registers and displays drill string torque for the drilling rig operator. Accordingly, when drill string torque gauge 82 registers the desired drill string torque, the drilling rig operator stops tightening adjusting screw 272. Alternatively, pneumatic pressure gauge 287 registers and displays the pressure of the compressed air nozzle 274 delivers to valve 238. Thus, when pneumatic pressure gauge 287 registers the desired compressed air pressure and, thus, the desired opening of valve 238, the drilling rig operator stops tightening adjusting screw 272.

With adjusting screw 272 no longer being tightened, the amount of compressed air valve 238 delivers to air motor 204 stabilizes to a constant amount. As a result, air motor 204 maintains brake 32 engaged against drum 26 at a constant force. Consequently, drum 26 will release cable 28 slowly so that drill string 21 will maintain drill string torque at its optimal level.

At this point, drill bit 23 should progress through formation 87 at the optimal rate of penetration. Unfortunately, even under optimal drilling conditions drill bit 23 will rise "off bottom", thus requiring drill string torque regulator 202 to readjust the release of cable 28 from drum 26. Any time drill bit 23 rises even slightly "off bottom", the torque drill string 21 applies to drill bit 23 decreases. Drill string torque sensor 36 measures that decrease and supplies Bourdon tube 270 with a hydraulic signal representing that decrease if the torque sensor depicted in FIG. 10 is utilized. Alternatively, if the torque sensor depicting in FIG. 11 is utilized, Bourdon tube 270 receives a pneumatic signal. In either case, any decrease in drill string torque registered by Bourdon tube 270 causes it to contract. As Bourdon tube 270 contracts, it drives flapper 271 to the left via its connection to flapper 271 at pivot screw 277. As flapper 271 moves left at pivot screw 277, its center point pivots about pin 279 to drive its opposite end towards nozzle outlet 282. The pivoting of flapper 271 to a position closer to nozzle 274 restricts additional compressed air flow from nozzle outlet 282 and redirects that compressed air flow into orifice 281. Orifice 281 delivers the compressed air to the top of diaphragm 242, thereby further opening valve 238. With valve 238 opened further, air motor 204 receives an additional amount of compressed air which increases the speed with which it rotates. In response, cable reel 206 raises brake handle 208 causing brake 32 to further disengage from drum 26. Consequently, drum 26 releases cable 28 an additional amount, thus lowering drill string 21. Drum 26 lowers drill string 21 until drill bit 23 again resides "on bottom" so that an increase in the torque drill string 21 applies to drill bit 23 may be effected.

As drill string torque returns to its optimal value, drill string torque sensor 36 registers that increase and supplies Bourdon tube 270 with either a hydraulic or pneumatic signal representing that increase. The increasing hydraulic fluid pressure within Bourdon tube 270 causes it to expand and pull flapper 271 to the right via its connection to flapper 271 at pivot screw 277. With flapper 271 pivoting to the right at pivot screw 277, its center pivots about pin 279 to drive its opposite end to the left, thereby moving it further from nozzle outlet 282. As a result, orifice 281 delivers less compressed air over top of diaphragm 242, while nozzle outlet 282 exhausts more compressed air. Consequently, valve 238 closes slightly to deliver less compressed air to air motor 204 causing it to rotate more slowly. In response, differential gear unit 205 releases cable reel 206 so that brake handle 208 lowers. Differential gear unit 205 includes a first shaft connected to cable reel 206 and a second shaft connected to wheel drum rotation sensor 90 via flexible shaft cable 91. Wheel drum rotation sensor 90 senses the rotation of drum 26 and transfers that rotation to the second shaft of differential gear unit 205 via flexible cable shaft 91. Accordingly, with air motor 204 rotating more slowly than drum 26, the second shaft speeds up relative to the first shaft resulting in the first shaft slowing down even further. The slowing down of the first shaft removes the driving force from cable reel 206, thus allowing it to unspool cable 207 to lower brake handle 208. With brake handle 208 lowered, brake 32 increases its braking of drum 26, resulting in the release of cable 28 slowing to its calibrated value.

Safety shut-down knob 276 functions to prevent drill string torque regulator 202 from releasing drill string 21 during either a drilling rig malfunction or dangerous drilling conditions. As previously described, drill string torque regulator 203 will release drill string 21 when it senses a decrease in drill string torque. Unfortunately, not every decrease in drill string torque should result in the release of drill string 21. For example, if drill string 21 breaks or drill bit 23 enters a cavern, drill string torque will decrease, however, drill string torque regulator 202 should not release drill string 21. The release of drill string 21 under such conditions could damage drilling rig 10 or create a situation, such as a blowout well, where injury to the drilling rig operators could occur.

In the event of a large decrease in drill string torque, safety shut-down knob 276 pivots flapper 271 from nozzle outlet 282. That is, under normal operation, Bourdon tube 270 pivots flapper 271 towards nozzle 274, thus causing nozzle 274 to open valve 238 further. However, if drill string torque drops below an operator set minimum, Bourdon tube 270 will push flapper 271 against safety shut-down knob 276. As Bourdon tube 270 pushes flapper 271 against safety shut-down knob 276, flapper 271 rotates in an arc to the right about pivot screw 277. As a result, the opposite end of flapper 271 pivots away from nozzle outlet 282 to allow nozzle outlet 282 to exhaust all the compressed air delivered from the air supply to nozzle 274. Accordingly, nozzle 274 delivers no compressed air to valve 238, and valve 238 closes. With valve 238 closed, air motor 204 shuts off to stop the release of cable 28 from drum 26, thereby ending the drilling operation.

As shown in FIG. 2, drill string RPM regulator 203 may be utilized to control a drilling operation. Specifically, drill string RPM regulator 203 measures changes in drill string RPM to regulate the rate at which drill bit 23 penetrates formation 87. For drill string RPM regulator 203 to control the drilling operation, valve selector 235 must be switched on, and valve selectors 232–234 must be switched off so that only drill string RPM regulator 203 regulates the flow of compressed air from the air supply to air motor 204. Drill string RPM regulator 203 ensures drill bit 23 progresses through formation 87 at an optimal rate of penetration by maintaining drill string RPM at an optimal level. As long as drill string RPM remains at that optimal level, drill bit 23 will reside "on bottom" with sufficient bit weight to drill borehole 86 through formation 87. Drill string RPM regulator 203 regulates drill string RPM by releasing cable 28 from drum 26 in response to changes in drill string RPM. The release of cable 28 lowers drill string 21 to place drill bit 23 "on bottom". With drill bit 23 "on bottom", drill string RPM decreases to its optimal value. Once the RPM of drill string 21 reaches its optimal value, drill string RPM regulator 203 stops the release of cable 28 to end the lowering of drill string 21.

Drill string RPM regulator 203 includes Bourdon tube 290 which connects to drill string RPM sensor 37 to sense changes in the RPM of drill string 21 and to control valve 239 accordingly. Drill string RPM regulator 203 further includes flapper 291, adjusting screw 292, plate 293, nozzle 294, spring 295, and safety shut-down knob 296. Flapper 291 connects to one end of Bourdon tube 290 with pivot screw 297, while spring 295 connects to plate 293 and flapper 291 in order to provide a restoring force that maintains flapper 291 near nozzle 294. Nozzle 294 mounts on plate 293 to deliver variable amounts of compressed air from the air supply to diaphragm 243 of valve 239 in response to changes in drill string RPM. Adjusting screw 292 connects to plate 293 in order to adjust plate 293 transverse to flapper 291 about pivot screw 298. That is, adjusting screw 292 swings the top of plate 293 in an arc about pivot screw 298 to position nozzle 294 either closer or further from flapper 291. In addition, plate 293 includes pivot pin 299 which provides the pivot point for flapper 291.

In normal operation, Bourdon tube 290 manipulates flapper 291 in response to changes in drill string RPM to vary the amount of compressed air nozzle 294 delivers to valve 239. That variable amount of compressed air alters the opening of valve 239 and, thus, the force with which the compressed air drives air motor 204. However, before drill string RPM regulator 203 will automatically regulate drill string RPM, nozzle 294 and flapper 291 must be calibrated to supply a driller operator selected amount of compressed air to valve 239.

To calibrate drill string RPM regulator 203 so that it automatically regulates drill string RPM, the drilling rig operators must first manually manipulate brake 32 to place drill bit 23 "on bottom". Once drill bit 23 resides "on bottom", the drilling rig operators connect cable 207 to brake handle 208. Adjustment screw 292 must then be adjusted to move nozzle 294 relative to flapper 291 so that it will deliver compressed air to valve 239. The delivery of compressed air by nozzle 294 opens valve 239, thereby allowing the actuation of air motor 204.

If adjustment screw 292 and, thus, nozzle 294 remain unadjusted, drill string RPM regulator 203 will not maintain a constant drill string RPM. Specifically, flapper 291 diverts no compressed air into orifice 301, and all the compressed air flowing into nozzle 294 through orifice 300 exhausts through nozzle outlet 302. Orifice 301, therefore, delivers no compressed air over top of diaphragm 243 which results in valve 239 remaining closed. With valve 239 closed, air motor 204 receives no compressed air, causing brake 32 to remain engaged. Consequently, drum 26 does not release cable 28 which results in drill bit 23 rising "off bottom". Thus, nozzle 294 must be adjusted to deliver the drilling rig operator selected amount of air pressure to air motor 204 so that optimal drill string RPM will be maintained.

Adjusting screw 292 threadably connects to plate 293 in order to adjust plate 293 and, thus, nozzle 294 transverse to flapper 291. As a drilling rig operator loosens adjusting screw 292, plate 293 pivots from left to right about pivot screw 298. That is, adjusting screw 292 swings the top of plate 293 in an arc from left to right about pivot screw 298 to position nozzle 294 closer to flapper 291. As a result, flapper 291 deflects the flow of compressed air from nozzle outlet 302 into orifice 301 which delivers the compressed air to valve 239. The diversion of the compressed air into valve 239 drives diaphragm 243 down to compress springs 303 and 304 and open valve 239. The tightening of adjusting screw 292 moves nozzle 294 away from flapper 291 to reduce or eliminate the diversion of compressed air into valve 239.

The opening of valve 239 allows compressed air from the air supply to flow from cavity 305 into cavity 306 and out from valve 239 into air motor 204. Compressed air initially flows to valve 239 because valve selectors 232–234 lock valves 236–238 open. The compressed air entering air motor 204 activates it and begins it rotating. As air motor 204 rotates, differential gear unit 205 transfers that motion to cable reel 206 which picks up brake handle 32 via cable 207 to lessen the braking force brake 32 exerts on drum 26. Consequently, drum 26 releases cable 28 to place more weight of drill string 21 on drill bit 23 causing a decrease in the RPM of drill string 21.

A drilling rig operator loosens adjusting screw 292 to cause the release of drill string 21 until the RPM of drill string 21 reaches its desired level. Drill string RPM gauge 83 (see FIG. 1) registers and displays drill string RPM for the drilling rig operator. Accordingly, when drill string RPM gauge 83 registers the desired drill string RPM, the drilling rig operator stops loosening adjusting screw 292. Alternatively, pneumatic pressure gauge 287 registers and displays the pressure of the compressed air nozzle 294 delivers to valve 239. Thus, when pneumatic pressure gauge 287 registers the desired compressed air pressure and, thus, the desired opening of valve 239, the drilling rig operator stops loosening adjusting screw 292.

With adjusting screw 292 no longer being loosened, the amount of compressed air valve 239 delivers to air motor 204 stabilizes to a constant amount. As a result, air motor 204 maintains brake 32 engaged against drum 26 at a constant force. Consequently, drum 26 will release cable 28 slowly so that the RPM of drill string 21 will maintain its optimal level.

At this point, drill bit 23 should progress through formation 87 at the optimal rate of penetration. Unfortunately, even under optimal drilling conditions drill bit 23 will rise "off bottom", thus requiring drill string RPM regulator 203 to readjust the release of cable 28 from drum 26. Any time drill bit 23 rises even slightly "off bottom", the RPM of drill string 21 increases. Drill string RPM sensor 37 measures that increase and supplies Bourdon tube 290 with a pneumatic signal representing that increase. Any increase in drill string RPM registered by Bourdon tube 290 causes it to expand. As Bourdon tube 290 expands, it pulls flapper 291 to the right via its connection to flapper 291 at pivot screw 297. As flapper 291 moves right at pivot screw 297, its center point pivots about pin 299 to drive its opposite end towards nozzle outlet 302. The pivoting of flapper 291 to a position closer to nozzle 294 restricts additional compressed air flow from nozzle outlet 302 and redirects that compressed air flow into orifice 301. Orifice 301 delivers the compressed air to the top of diaphragm 243, thereby further opening valve 239. With valve 239 opened further, air motor 204 receives an additional amount of compressed air which increases the speed with which it rotates. In response, cable reel 206 raises brake handle 208 causing brake 32 to further disengage from drum 26. Consequently, drum 26 releases cable 28 an additional amount, thus lowering drill string 21. Drum 26 lowers drill string 21 until drill bit 23 again resides "on bottom" so that an decrease in the RPM of drill string 21 may be effected.

As drill string RPM returns to its optimal value, drill string RPM sensor 37 registers that decrease and supplies Bourdon tube 290 with either a pneumatic signal representing that decrease. The decreasing hydraulic fluid pressure within Bourdon tube 290 causes it to contract and push flapper 291 to the left via its connection to flapper 291 at pivot screw 297. With flapper 291 pivoting to the left at pivot screw 297, its center pivots about pin 299 to drive its opposite end to the right, thereby moving it further from nozzle outlet 302. As a result, orifice 301 delivers less compressed air over top of diaphragm 243, while nozzle outlet 302 exhausts more compressed air. Consequently, valve 239 closes slightly to deliver less compressed air to air motor 204 causing it to rotate more slowly. In response, differential gear unit 205 releases cable reel 206 so that brake handle 208 lowers. Differential gear unit 205 includes a first shaft connected to cable reel 206 and a second shaft connected to wheel drum rotation sensor 90 via flexible shaft cable 91. Wheel drum rotation sensor 90 senses the rotation of drum 26 and transfers that rotation to the second shaft of differential gear unit 205 via flexible cable shaft 91. Accordingly, with air motor 204 rotating more slowly than drum 26, the second shaft speeds up relative to the first shaft resulting in the first shaft slowing down even further. The slowing down of the first shaft removes the driving force from cable reel 206, thus allowing it to unspool cable 207 to lower brake handle 208. With brake handle 208 lowered, brake 32 increases its braking of drum 26, resulting in the release of cable 28 slowing to its calibrated value.

Safety shut-down knob 296 functions to prevent drill string RPM regulator 203 from releasing drill string 21 during either a drilling rig malfunction or dangerous drilling conditions. As previously described, drill string RPM regulator 203 will release drill string 21 when it senses an increase in drill string RPM. Unfortunately, not every increase in drill string RPM should result in the release of drill string 21. For example, if drill string 21 breaks or drill bit 23 enters a cavern, drill string RPM will increase, however, drill string RPM regulator 202 should not release drill string 21. The release of drill string 21 under such conditions could damage drilling rig 10 or create a situation, such as a blowout well, where injury to the drilling rig operators could occur.

In the event of a large increase in drill string RPM, safety shut-down knob 296 pivots flapper 291 from nozzle outlet 302. That is, under normal operation, Bourdon tube 290 pivots flapper 291 towards nozzle 294, thus causing nozzle 294 to open valve 239 further. However, if drill string RPM increases above an operator set minimum, Bourdon tube 290 will pull flapper 291 against safety shut-down knob 296. As Bourdon tube 290 pulls flapper 291 against safety shut-down knob 296, flapper 291 rotates in an arc to the left about pivot screw 297. As a result, the opposite end of flapper 291 pivots away from nozzle outlet 302 to allow nozzle outlet 302 to exhaust all the compressed air delivered from the air supply to nozzle 294. Accordingly, nozzle 294 delivers no compressed air to valve 239, and valve 239 closes. With valve 239 closed, air motor 204 shuts off to stop the release of cable 28 from drum 26, thereby ending the drilling operation.

Although the operation of each of regulators 200–203 to control a drilling operation was described individually, regulators 200–203 may be switched on in any combination, including all of them, to regulate the rate drill bit 23 penetrates into formation 87. However, when more than one of regulators 200–203 is utilized to control a drilling operation, one regulator is adjusted to maintain a desired drilling parameter, while the remaining regulators act as secondary controls.

Illustratively, drilling fluid pressure regulator 200 and bit weight regulator 201 could be switched on while drill string torque regulator 202 and drill string RPM regulator 203 could be switched off. That is, valve selectors 234 and 235 are switched off to keep valves 238 and 239 open, thereby maintaining drill string torque regulator 202 and drill string RPM regulator 203 off, while valve selectors 232 and 233 are switched on to allow drilling fluid pressure regulator 200 and bit weight regulator 201 to control their respective valves 236 and 237.

In the above control configuration, drilling fluid pressure regulator 200 could be adjusted to maintain an operator selected drilling fluid pressure within drill string 21. Additionally, bit weight regulator 201 would then be adjusted to a bit weight value higher than the bit weight required to maintain the operator selected drilling fluid pressure. As a result, drilling fluid pressure regulator 200 would provide primary control of the drilling operation, while bit weight regulator 201 would provide a secondary control in the event bit weight decreased significantly without a corresponding decrease in drilling fluid pressure.

Figure 9:
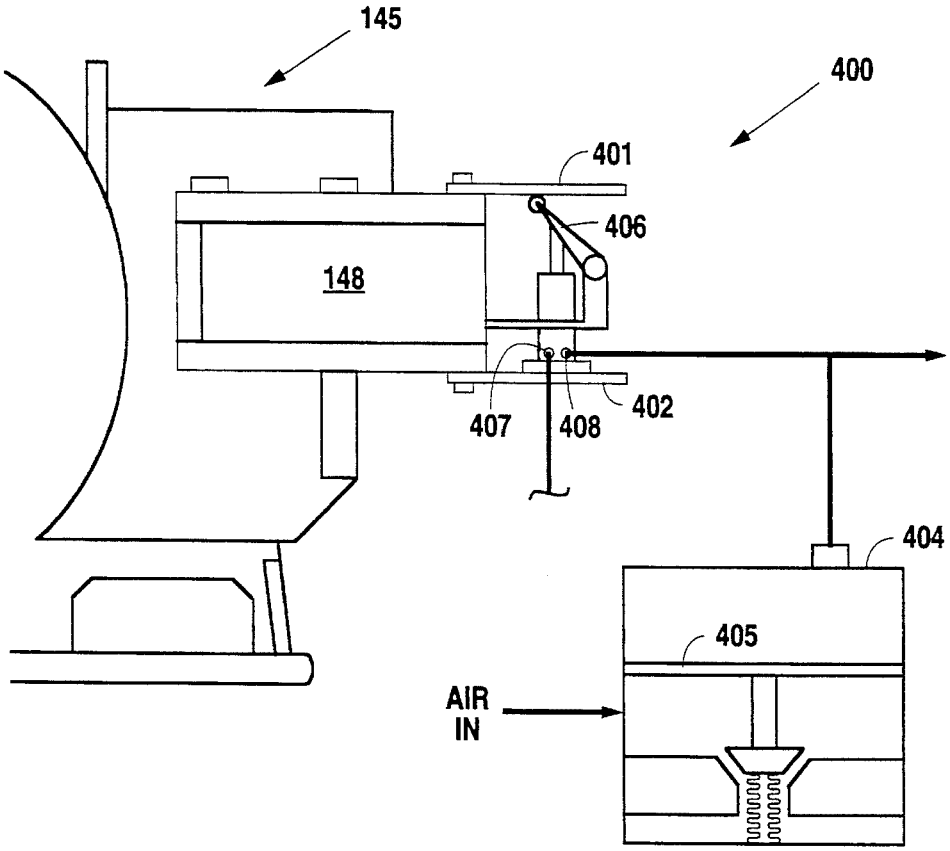
FIG. 9 is a schematic diagram depicting a low fluid warning apparatus and cut-off switch utilized in the drill line tension sensor illustrated in FIG. 8.

FIG. 9 illustrates a low fluid level warning and shutdown system utilized with the drilling cable anchor weight indicator depicted in FIG. 8. As previously described, drilling cable anchor weight indicator 145 employs arm 147 to exert pressure against diaphragm 148, thus compressing diaphragm 148 to apply a force against the hydraulic fluid within diaphragm 148. Unfortunately, the constant pressure diaphragm 148 experiences results in its deteriorating to the point where hydraulic fluid leaks from it. With insufficient hydraulic fluid, drilling cable anchor weight indicator 145 outputs a value of bit weight which is less than the actual bit weight. Accordingly, if automatic driller 33 were utilizing bit weight to control the drilling operation, it would receive a low bit weight signal and release the drilling cable even though there already was sufficient bit weight. Consequently, bit weight will increase past acceptable levels, resulting in, at the minimum, an inefficient drilling operation, and, at the maximum, a drilling rig malfunction that destroys equipment or possibly causes drilling rig operator casualties.

To indicate when diaphragm 148 loses fluid, low fluid warning and shutdown system 400 mounts onto diaphragm 148. Plates 401 and 402 mount onto diaphragm 148 using any suitable means such as screws or welding to provide a base for air valve 403. Low fluid warning and shutdown system 400 includes valve 404 which acts as a relay. The air supply (not shown) connects to valve 404 which, in turn, connects to air flow regulator 212, valve selectors 232–235, and nozzles 216, 254, 274, and 294. Valve 404 further connects to air valve 403, which controls diaphragm 405 of valve 404 in the event of hydraulic fluid loss from diaphragm 148. During normal operation, valve 404 remains open to pass compressed air to automatic driller 33, thereby allowing normal operation of automatic driller 33 as previously described.

However, if air valve 403 detects hydraulic fluid loss from diaphragm 148, it will close valve 404 to shut off automatic driller 33. Air valve 403 includes an adjustable arm 406 which serves as the sensor to detect low hydraulic fluid level in diaphragm 148. Air valve 403 receives compressed air from the air supply at orifice 407. If there is no fluid loss, that compressed air vents to the atmosphere through an orifice (not shown). However, if fluid loss occurs, plates 401 and 402 compress arm 406 so that it blocks the venting orifice to shunt the compressed air out orifice 408. Orifice 408 delivers the compressed air to valve 404 to close diaphragm 405 and, thus, valve 404. With valve 404 closed, automatic driller 33 receives no compressed air and turns off to stop the drilling operation. Additionally, orifice 408 delivers the compressed air to an air horn which warns the drilling rig operators of the low fluid condition in diaphragm 148 of drilling cable anchor weight indicator 145.

Figure 14:
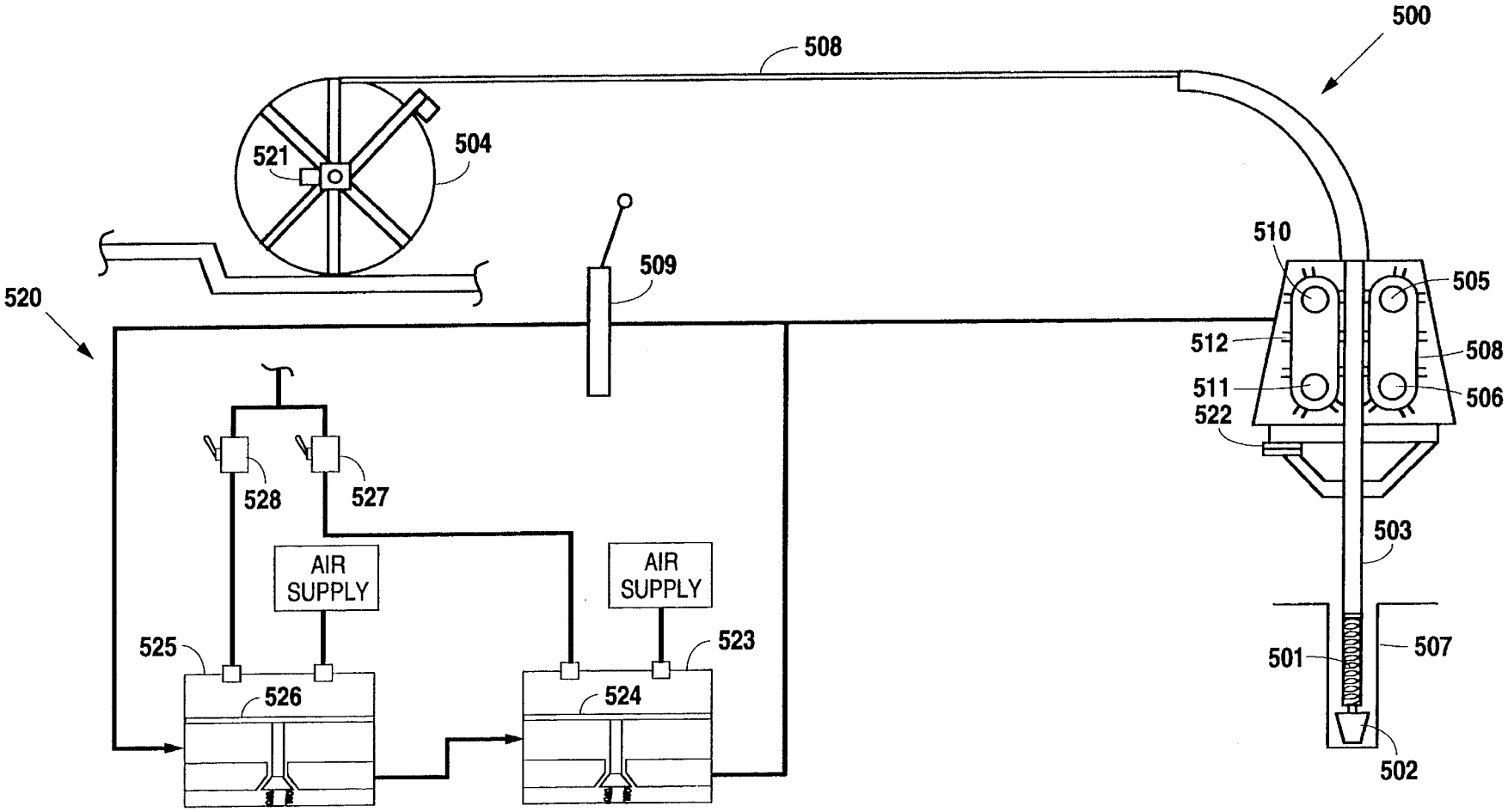
FIG. 14 is a schematic diagram depicting an alternative embodiment of the automatic drilling system configured to control a coil tubing drilling rig.

FIG. 14 illustrates a second embodiment of the automatic driller of the present invention configured to regulate a coil tubing drilling rig. Coil tubing drilling rig 500 includes only mud motor 501 to drive drill bit 502. Consequently, drill string 503 does not rotate, and, thus, the need for a drill string torque regulator and a drill string RPM regulator is eliminated. In coil tubing drilling rig 500, drill string 503 is a flexible steel pipe wound about spool drum 504. Coil tubing drilling rig 500 includes hydraulically driven motors 505, 506, 510, and 511 which unspool drill string 503 from spool drum 504 into borehole 507. Chain 508 couples motors 505 and 506 and chain 512 couples motors 510 and 511 together so that the motors operate in unison to drive drill string 503 into borehole 507. Specifically, a hydraulic power source (not shown) delivers hydraulic fluid to motors 505, 506, 510, and 511 under the control of hydraulic valve 509. As motors 505, 506, 510, and 511 rotate, chains 508 and 512 engage drill string 503 to lower it into borehole 507. Alternatively, motors 505, 506, 510, and 511 may be driven in the opposite direction to pull drill string 503 from borehole 507 and respool it on spool drum 504. Finally, coil tubing drilling rig 500 includes a drilling fluid pump (not shown) that supplies the drilling fluid necessary to drive mud motor 501.

Automatic driller 520 connects to drilling fluid pressure sensor 521 and bit weight sensor 522 in order to receive signals representing drilling fluid pressure and bit weight. In this second embodiment, drilling fluid pressure sensor 521 may be either the sensor depicted in FIG. 4 or the sensor depicted in FIG. 5, while bit weight sensor 522 may be a Martin-Decker hydraulic load cell. Alternatively, a pressure transducer could be substituted for the Martin-Decker hydraulic load cell. In such a case, the electrical output of the transducer would be input into an electrical to pneumatic transducer so that a pneumatic signal representing bit weight would be supplied to automatic driller 520.

Automatic driller 520 includes a drilling fluid pressure regulator (not shown) identical, both in design and operation, to drilling fluid pressure regulator 200 depicted in FIG. 3. Additionally, if the Martin-Decker hydraulic load cell is used to measure bit weight, automatic driller 520 includes a bit weight regulator (not shown) identical, both in design and operation, to bit weight regulator 201 depicted in FIG. 2. However, if the pressure transducer is used to determine bit weight, automatic driller 520 includes a bit weight regulator employing a pneumatic Bourdon tube. Nevertheless, the pneumatic output signal from either bit weight regulator utilized by automatic driller 520 is identical to the pneumatic output signal of bit weight regulator 201.

The drilling fluid regulator of automatic driller 520 receives the hydraulic signal representing drilling fluid pressure from drilling fluid pressure sensor 521 and converts any changes in drilling fluid pressure into a pneumatic signal representing those changes. The drilling fluid pressure regulator outputs its pneumatic signal to valve 523 in order to regulate diaphragm 524 and, thus, the opening of valve 524. Similarly, the bit weight regulator of automatic driller 520 receives the hydraulic or pneumatic signal representing bit weight from bit weight sensor 521 and converts any changes in drilling fluid pressure into a pneumatic signal representing those changes. The bit weight regulator then outputs its pneumatic signal to valve 525 in order to regulate diaphragm 526 and, thus, the opening of valve 525.

Automatic driller 520 further includes valve selectors 527 and 528 which are identical, both in design and operation, to valve selectors 232–235 depicted in FIG. 2. That is, valve selectors 527 and 528 allow the operator of automatic driller 520 to select which regulator will control the drilling operation or if both regulators are to control the drilling operation concurrently. Additionally, as in automatic driller 33, the drilling fluid pressure regulator, the bit weight regulator, valve selector 527, and valve selector 528 connect to an air supply to deliver compressed air to their respective valves 523 and 525.

Valves 523 and 525 are similar to valves 236–239 of automatic driller 33, except that they are pneumatically operated hydraulic valves utilized to deliver hydraulic fluid to motors 505, 506, 510, and 511 rather than pneumatic valves that deliver compressed air to air motor 204. Thus, when valves 523 and 525 are open, they deliver hydraulic fluid from the hydraulic power source to drive motors 505, 506, 510, and 511 and, thus lower drill string 503 into borehole 507.

Automatic driller 520 functions to eliminate the need for manual control of motors 505, 506, 510, and 511 via hydraulic valve 509. That is, if drilling fluid pressure is to be utilized to control the drilling operation, valve selector 528 opens valve 525, and a drilling rig operator adjusts drilling fluid pressure regulator to maintain drill bit 502 "on bottom". Specifically, once drill bit 502 resides "on bottom", the drilling rig operator adjusts the adjusting screw of drilling fluid pressure regulator to open valve 523 so that the hydraulic power source delivers hydraulic fluid to motors 505, 506, 510, and 511. Consequently, motors 505, 506, 510, and 511 rotate to place additional weight of drill string 503 onto drill bit 502, resulting in an increase in drilling fluid pressure within drill string 503. The drilling rig operator continues to adjust the adjusting screw of the drilling fluid pressure regulator until drilling fluid pressure reaches its optimal value. After the optimal drilling fluid pressure is reached, the adjustment of the adjusting screw ceases.

At this point, the hydraulic power source will deliver sufficient hydraulic fluid to motors 505, 506, 510, and 511 so that they will drive drill string 503 to maintain drill bit 502 "on bottom" with the optimal drilling fluid pressure. However, drill bit 502 will invariably rise "off bottom" during some point in the drilling of borehole 507. When that occurs, the drilling fluid pressure regulator will register the decrease in drilling fluid pressure and open valve 523 further so that the hydraulic power source will deliver additional hydraulic fluid to motors 505. 506, 510, and 511. As a result, motors 505, 506, 510, and 511 will drive drill string 503 further within borehole 507 to again place drill bit 502 "on bottom" with the appropriate drilling fluid pressure. Once the drilling fluid pressure returns to its calibrated value, the drilling fluid pressure regulator will close valve 523 slightly to maintain drill bit 502 "on bottom" with the optimal drilling fluid pressure within drill string 503.

Alternatively, if bit weight is to be utilized to control the drilling operation, valve selector 527 opens valve 523, and a drilling rig operator adjusts bit weight regulator to maintain drill bit 502 "on bottom". Specifically, once drill bit 502 resides "on bottom", the drilling rig operator adjusts the adjusting screw of bit weight regulator to open valve 525 so that the hydraulic power source delivers hydraulic fluid to motors 505, 506, 510, and 511. Consequently, motors 505, 506, 510, and 511 rotate to place additional weight of drill string 503 onto drill bit 502. The drilling rig operator continues to adjust the adjusting screw of the bit weight regulator until the weight drill string 503 place upon drill bit 502 reaches its optimal value. After the optimal bit weight is reached, the adjustment of the adjusting screw ceases.

At this point, the hydraulic power source will deliver sufficient hydraulic fluid to motors 505, 506, 510, and 511 so that they will drive drill string 503 to maintain drill bit 502 "on bottom" with sufficient bit weight. However, drill bit 502 will invariably rise "off bottom" during some point in the drilling of borehole 507. When that occurs, the bit weight regulator will register the decrease in bit weight and open valve 525 further so that the hydraulic power source will deliver additional hydraulic fluid to motors 505, 506, 510, and 511. As a result, motors 505, 506, 510 and 511 will drive drill string 503 further within borehole 507 to again place drill bit 502 "on bottom" with the appropriate weight of drill string 503 residing on top. Once bit weight returns to its calibrated value, the bit weight regulator will close valve 525 slightly to maintain drill bit 502 "on bottom" with drill string 503 applying the optimal weight to drill bit 502.

Although the operation of the drilling fluid pressure regulator and the bit weight regulator to control a drilling operation was described individually, both regulator may be switched on to regulate the rate drill bit 502 penetrates into the formation. However, when both regulators are utilized to control a drilling operation, one regulator is adjusted to maintain the desired drilling parameter, while the other regulator acts as a secondary control.

Specifically, when both the drilling fluid pressure regulator and the bit weight regulator are to control the drilling operation, valve selectors 527 and 528 are switched on to allow the drilling fluid pressure regulator and the bit weight regulator to control their respective valves 523 and 525. In the above control configuration, the drilling fluid pressure regulator could be adjusted to maintain an operator selected drilling fluid pressure within drill string 503. Additionally, the bit weight regulator would then be adjusted to a bit weight value higher than the bit weight required to maintain the operator selected drilling fluid pressure. As a result, the drilling fluid pressure regulator would provide primary control of the drilling operation, while the bit weight regulator would provide a secondary control in the event bit weight decreased significantly without a corresponding decrease in drilling fluid pressure.

Although the present invention has been described in terms of the foregoing embodiments, such description has been for exemplary purposes only, and, as will be apparent to those of ordinary skill in the art, many alternatives, equivalents, and variations of varying degrees will fall within the scope of the present invention. That scope, accordingly, is not to be limited in any respect by the foregoing description, but, rather, it is to be defined only by the claims which follow.

I claim:

1. An automatic drilling system for automatically regulating the release of the drill string of a drilling rig during the drilling of a borehole, comprising:

a drilling fluid pressure sensor;

a drilling fluid pressure regulator coupled to said drilling fluid pressure sensor, said drilling fluid pressure regulator measuring changes in drilling fluid pressure and outputting a signal representing those changes;

a relay coupled to said drilling fluid pressure regulator, said relay responsive to the output signal of said drilling fluid pressure regulator to supply a drill string control signal at an output thereof; and a drill string controller coupled to said relay wherein a decrease in drilling fluid pressure results in said relay supplying a drill string control signal that operates said drill string controller to effect an increase in the rate of release of said drill string and an increase in drilling fluid pressure results in said relay supplying a drill string control signal that operates said drill string controller to effect a decrease in the rate of release of said drill string.

2. The automatic drilling system according to claim 1, further comprising:

a bit weight sensor;

a bit weight regulator coupled to said bit weight sensor, said bit weight regulator measuring changes in bit weight and outputting a signal representing those changes;

a relay coupled to said bit weight regulator, said relay responsive to the output signal of said bit weight regulator to supply a drill string control signal at an output thereof; and said drill string controller coupled to said relay wherein a decrease in bit weight results in said relay supplying a drill string control signal that operates said drill string controller to effect an increase in the rate of release of said drill string and an increase in bit weight results in said relay supplying a drill string control signal that operates said drill string controller to effect a decrease in the rate of release of said drill string.

3. The automatic drilling system according to claim 1 further comprising:

a drill string torque sensor;

a drill string torque regulator coupled to said drill string torque sensor, said drill string torque regulator measuring changes in drill string torque and outputting a signal representing those changes;

a relay coupled to said drill string torque regulator, said relay responsive to the output signal of said drill string torque regulator to supply a drill string control signal at an output thereof; and a drill strings controller coupled to said relay wherein a decrease in drill string torque results in said relay supplying a drill strings control signal that operates said drill strings controller to effect an increase in the rate of release of said drill string and an increase in drill string torque results in said relay supplying a drill strings control signal that operates said drill strings controller to effect a decrease in the rate of release of said drill string.

4. The automatic drilling system according to claim 1 further comprising:

a drill string RPM sensor;

a drill string RPM regulator coupled to said drill string RPM sensor, said drill string RPM regulator measuring changes in drill string RPM and outputting a signal representing those changes;

a relay coupled to said drill string RPM regulator, said relay responsive to the output signal of said drill string RPM regulator to supply a drill strings control signal at an output thereof; and a drill strings controller coupled to said relay wherein an increase in drill string RPM results in said relay supplying a drill strings control signal that operates said drill strings controller to effect an increase in the rate of release of said drill string and a decrease in drill string RPM results in said relay supplying a drill strings control signal that operates said drill strings controller to effect a decrease in the rate of release of said drill string.

5. The automatic drilling system according to claim 1 wherein said drilling fluid pressure regulator, comprises:

a Bourdon tube coupled to said drilling fluid pressure sensor to measure changes in drilling fluid pressure;

a flapper coupled at one end to said Bourdon tube wherein said flapper pivots about a pivot point in response to changes in drilling fluid pressure measured by said Bourdon tube; and means responsive to the pivoting of said flapper for outputting to said relay a signal representative of changes in drilling fluid pressure.

6. The automatic drilling system according to claim 2 wherein said bit weight regulator, comprises:

a Bourdon tube coupled to said bit weight sensor to measure changes in bit weight;

a flapper coupled at one end to said Bourdon tube wherein said flapper pivots about a pivot point in response to changes in bit weight measured by said Bourdon tube; and means responsive to the pivoting of said flapper for outputting a signal to said relay representative of changes in bit weight.

7. The automatic drilling system according to claim 3 wherein said drill string torque regulator, comprises:

a Bourdon tube coupled to said drill string torque sensor to measure changes in drill string torque;

a flapper coupled at one end to said Bourdon tube wherein said flapper pivots about a pivot point in response to changes in drill string torque measured by said Bourdon tube; and means responsive to the pivoting of said flapper for outputting a signal to said relay representative of changes in drill string torque.

8. The automatic drilling system according to claim 4 wherein said drill string RPM regulator, comprises:

a Bourdon tube coupled to said drill string RPM sensor to measure changes in drill string RPM;

a flapper coupled at one end to said Bourdon tube wherein said flapper pivots about a pivot point in response to changes in drill string RPM measured by said Bourdon tube; and means responsive to the pivoting of said flapper for outputting a signal to said relay representative of changes in drill string RPM.

9. An automatic drilling system for automatically regulating the releasing of the drill string of a drilling rig during the drilling of a borehole, comprising:

a drilling fluid pressure sensor;

a bit weight sensor;

a drilling fluid pressure regulator responsive to changes in drilling fluid pressure for outputting a signal representative of those changes;

a bit weight regulator responsive to changes in bit weight for outputting a signal representative of those changes;

a first relay connected to said drilling fluid pressure regulator, said first relay responsive to the output signal of said drilling fluid pressure regulator to supply a first drill string control signal at an output thereof;

a second relay connected to said bit weight regulator, said first relay responsive to the output signal of said bit weight regulator to supply a second drill string control signal at an output thereof;

a relay selector connected to said first and second relay to select any one of said first drill string control signal, said second drill string control signal, and both of said first and second drill string control signals to control the release of said drill string; and a drill string controller coupled to said first and second relays wherein when said first drill string control signal represents a decrease in drilling fluid pressure, said drill string controller increases the rate of release of said drill string and when said first drill string control signal represents an increase in drilling fluid pressure, said drill string controller increases the rate of release of said drill string, and further wherein when said second drill string control signal represents a decrease in bit weight, said drill string controller decreases the rate of release of said drill string and when said second drill string control signal represents an increase in bit weight, said drill string controller decreases the rate of release of said drill string.

10. The automatic drilling system according to claim 9, further comprising:

a drill string torque sensor;

a drill string RPM sensor;

a drill string torque regulator responsive to changes in drill string torque for outputting a signal representative of those changes;

a drill string RPM regulator responsive to changes in drill string RPM for outputting a signal representative of those changes;

a third relay connected to said drill string torque regulator, said third relay responsive to the output signal of said drill string torque regulator to supply a third drill string control signal at an output thereof;

a fourth relay connected to said drill string RPM regulator, said fourth relay responsive to the output signal of said drill string RPM regulator to supply a fourth drill string control signal at an output thereof;

said relay selector further connected to said third and fourth relays to select any one of said first, second, third, and fourth drill string control signals, a combination of said first, second, third, and fourth drill string control signals, and all of said first, second, third, and fourth drill string control signals to control the release of said drill string; and said drill string controller coupled to said third and fourth relays wherein when said third drill string control signal represents a decrease in drill string torque, said drill string controller increases the rate of release of said drill string and when said third drill string control signal represents an increase in drill string torque, said drill string controller decreases the rate of release of said drill string, and further wherein when said fourth drill string control signal represents a increase in drill string RPM, said drill string controller increases the rate of release of said drill string and when said fourth drill string control signal represents a decrease in drill string RPM, said drill string controller decreases the rate of release of said drill string.

11. A method for automatically regulating the release of the drill string of a drilling rig drill, comprising the steps of:

measuring drilling fluid pressure;

producing a signal in response to changes in drilling fluid pressure, said signal representing the changes in drilling fluid pressure;

relaying said signal to a drill string controller; and controlling said drill string controller to increase the rate of release of said drill string when said signal represents a decrease in drilling fluid pressure and to decrease the rate of release of said drill string when said signal represents an increase in drilling fluid pressure.

12. The method according to claim 11 further comprising the steps of:

measuring drill string torque;

producing a signal in response to changes in drill string torque, said signal representing the changes in drill string torque; and relaying said signal to a drill string controller;

controlling said drill string controller to increase the rate of release of said drill string when said signal represents a decrease in drill string torque and to decrease the rate of release of said drill string when said signal represents an increase in drill string torque.

13. The method according to claim 11 further comprising the steps of:

measuring drill string RPM;

producing a signal in response to changes in drill string RPM, said signal representing the changes in drill string RPM;

relaying said signal to a drill string controller; and controlling said drill string controller to increase the rate of release of said drill string when said signal represents a increase in drill string RPM and to decrease the rate of release of said drill string when said signal represents an decrease in drill string RPM.

14. A method for automatically regulating the release of the drill string of a drilling rig drill, comprising the steps of:

measuring drilling fluid pressure and bit weight;

producing a first signal in response to changes in drilling fluid pressure, said first signal representing the changes in drilling fluid pressure;

producing a second signal in response to changes in bit weight, said second signal representing the changes in bit weight;

selecting any one of said first signal, said second signal, and both said first and said second signals to control the release of said drill string; and relaying said selected signal or signals to a drill string controller which regulates the release said drill string in response to said selected signal or signals.

15. The method according to claim 14, further comprising the steps of:

measuring drill string torque and drill string RPM producing a third signal in response to changes in drill string torque, wherein said third signal represents the changes in drill string torque;

producing a fourth signal in response to changes in drill string RPM, wherein said fourth signal represents the changes in drill string RPM;

selecting any one of said first, second, third, and fourth signals, a combination of said first, second, third, and fourth signals, and all of said first, second, third, and fourth signals to regulate the release of said drill string; and relaying said selected signal or signals to a drill string controller which regulates the release said drill string in response to said selected signal or signals.

* * * * *

US005474142C1

(12) EX PARTE REEXAMINATION CERTIFICATE (5436th)

United States Patent
Bowden

(10) Number: US 5,474,142 C1
(45) Certificate Issued: Jul. 4, 2006

(54) AUTOMATIC DRILLING SYSTEM

(75) Inventor: Bobbie J. Bowden, Gonzales, TX (US)

(73) Assignee: Wildcat Services, L.P., Cypress, TX (US)

Reexamination Request:
No. 90/006,919, Jan. 26, 2004

Reexamination Certificate for:
Patent No.: 5,474,142
Issued: Dec. 12, 1995
Appl. No.: 08/050,527
Filed: Apr. 19, 1993

(51) Int. Cl.
*E21B 19/08* (2006.01)

(52) U.S. Cl. ..... 175/27; 175/162; 175/57
(58) Field of Classification Search ..... None
See application file for complete search history.

(56) References Cited

U.S. PATENT DOCUMENTS 3,223,183 A 12/1965 Varney ..... 175/27

*Primary Examiner*—Matthew C. Graham

(57) ABSTRACT

An automatic drilling system regulates the drill string of a drilling rig in response to any one of, any combination of, or all of drilling fluid pressure, bit weight, drill string torque, and drill string RPM to achieve an optimal rate of bit penetration. The automatic drilling system includes a drilling fluid pressure sensor, a bit weight sensor, a drill string torque sensor, and a drill string RPM sensor which deliver a drilling fluid pressure signal, a bit weight signal, a drill string torque signal, and a drill string RPM signal to a drilling fluid pressure regulator, a bit weight regulator, a drill string torque regulator, and a drill string RPM regulator. The regulators control a drill string controller in response to the above signals so that it manipulates the drilling rig to release the drill string at a rate which maintains the maximum rate of bit penetration.

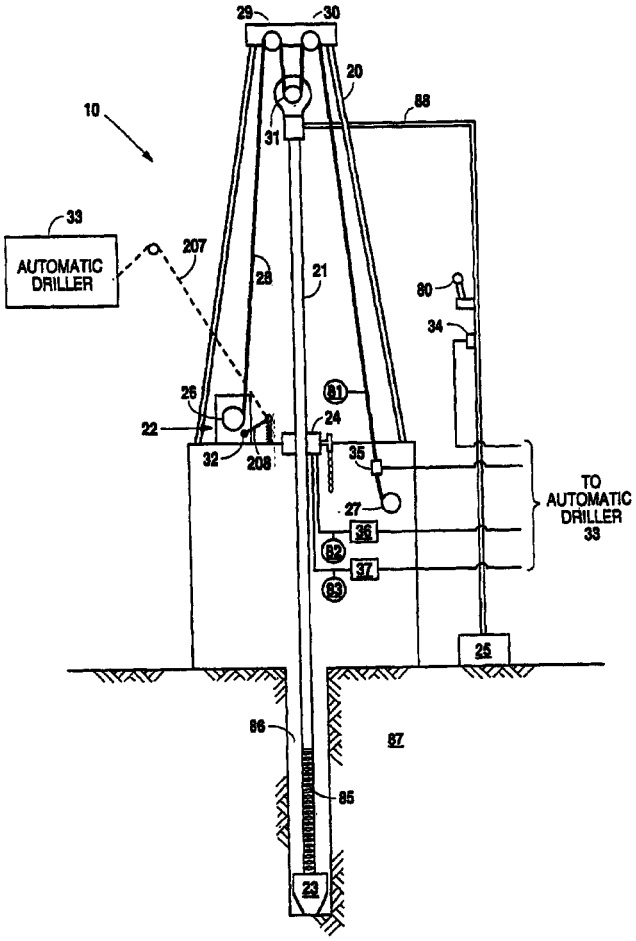

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–15 is confirmed.

* * * * *

US005474142C2

(12) EX PARTE REEXAMINATION CERTIFICATE (7613th)

United States Patent

Bowden

(10) Number: US 5,474,142 C2

(45) Certificate Issued: Jul. 13, 2010

(54) AUTOMATIC DRILLING SYSTEM

(75) Inventor: Bobbie J. Bowden, Gonzales, TX (US)

(73) Assignee: MD/Totco, a division of Varco, L.P., Houston, TX (US)

Reexamination Request:
No. 90/010,615, Jul. 24, 2009

Reexamination Certificate for:

| | |
|---|---|
| Patent No.: | **5,474,142** |
| Issued: | **Dec. 12, 1995** |
| Appl. No.: | **08/050,527** |
| Filed: | **Apr. 19, 1993** |

Reexamination Certificate C1 5,474,142 issued Jul. 4, 2006

(51) Int. Cl.

| | |
|---|---|
| ***E21B 44/00*** | (2006.01) |
| ***E21B 44/02*** | (2006.01) |
| ***E21B 19/08*** | (2006.01) |

(52) U.S. Cl. ..... 175/27; 175/162; 175/57; 73/732; 73/790

(58) Field of Classification Search ..... None
See application file for complete search history.

(56) References Cited

U.S. PATENT DOCUMENTS

| | | | |
|---|---|---|---|
| 1,891,329 | A | 12/1932 | LeCompte et al. |
| 2,005,889 | A | 6/1935 | Dillon et al. |
| 3,223,183 | A | 12/1965 | Varney |
| 3,265,359 | A | 8/1966 | Bowden |
| 3,550,697 | A | 12/1970 | Hobhouse |
| 4,662,608 | A | 5/1987 | Ball |
| 4,854,397 | A | 8/1989 | Warren et al. |

OTHER PUBLICATIONS

J.F. Brett, T.M. Warren, and D.E. Walt, "Field Experiences With Computer–Controlled Drilling", Society of Petroleum Engineers publication SPE 20107 (1990).

F.S. Young, Jr., "Computerized Drilling Control", Journal of Petroleum Technology, Apr. 1969.

*Primary Examiner*—Peter C. English

(57) ABSTRACT

An automatic drilling system regulates the drill string of a drilling rig in response to any one of, any combination of, or all of drilling fluid pressure, bit weight, drill string torque, and drill string RPM to achieve an optimal rate of bit penetration. The automatic drilling system includes a drilling fluid pressure sensor, a bit weight sensor, a drill string torque sensor, and a drill RPM sensor which deliver a drilling fluid pressure signal, a bit weight signal, a drill string torque signal, and a drill string RPM signal to a drilling fluid pressure regulator, a bit weight regulator, a drill string torque regulator, and a drill string RPM regulator. The regulators control a drill string controller in response to the above signals so that it manipulates the drilling rig to release the drill string at a rate which maintains the maximum rate of bit penetration.

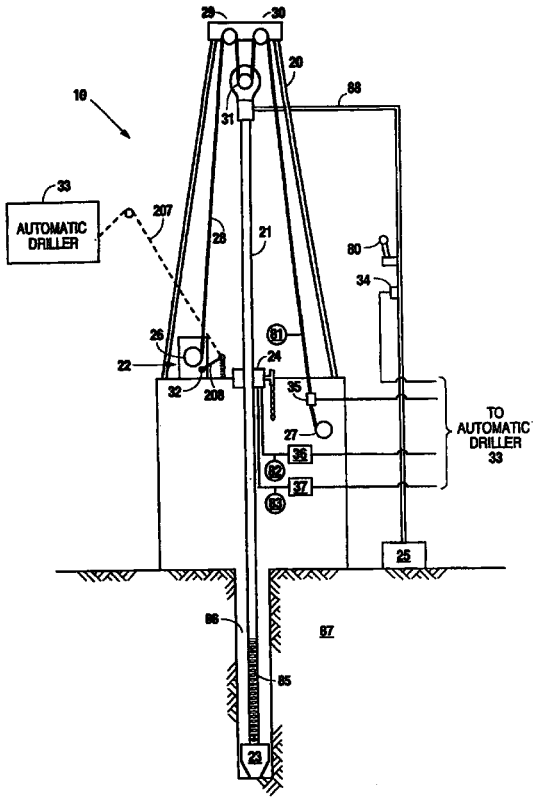

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 14 and 15 is confirmed.

Claims 1 and 11 are determined to be patentable as amended.

Claims 2-8, 12 and 13, dependent on an amended claim, are determined to be patentable.

Claims 9 and 10 were not reexamined.

1. An automatic drilling system for automatically regulating the release of the drill string of a drilling rig *having a drill bit in association therewith* during the drilling of a borehole, comprising:

a drilling fluid pressure sensor;

a drilling fluid pressure regulator coupled to said drilling fluid pressure sensor, said drilling fluid pressure regulator measuring changes in drilling fluid pressure and outputting a signal representing those changes;

a relay coupled to said drilling fluid pressure regulator, said relay responsive to the output signal of said drilling fluid pressure regulator to supply a drill string control signal at an output thereof; and a drill string controller coupled to said relay wherein a decrease in drilling fluid pressure results in said relay supplying a drill string control signal that operates said drill string controller to effect an increase in the rate of release of said string *with direct effect at the drill bit associated with the drill string* and an increase in drilling fluid pressure results in said relay supplying a drill string control signal that operates said drill string controller to effect a decrease in the rate of release of said drill string *with direct effect at the drill bit associated with the drill string*.

11. A method for automatically regulating the release of the drill string of a drilling rig drill *having a drill bit in association therewith*, comprising the steps of:

measuring drilling fluid pressure;

producing a signal in response to changes in drilling fluid pressure, said signal representing the changes in drilling fluid pressure;

relying said signal to a drill string controller; and controlling said drill string controller to increase the rate of release of said drill string *with direct effect at the drill bit associated with the drill string* when said signal represents a decrease in drilling fluid pressure and to decrease the rate of release of said drill string *with direct effect at the drill bit associated with the drill string* when said signal represents an increase in drilling fluid pressure.

* * * * *